US009354549B1

(12) United States Patent
Okino et al.

(10) Patent No.: US 9,354,549 B1
(45) Date of Patent: May 31, 2016

(54) DEVELOPER SUPPLY CONTAINER, DEVELOPER SUPPLYING APPARATUS AND IMAGE FORMING APPARATUS

(71) Applicant: CANON KABUSHIKI KAISHA, Tokyo (JP)

(72) Inventors: Ayatomo Okino, Moriya (JP); Toshiaki Nagashima, Moriya (JP); Katsuya Murakami, Toride (JP); Fumio Tazawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/935,880

(22) Filed: Nov. 9, 2015

(30) Foreign Application Priority Data

Nov. 10, 2014 (JP) ..... 2014-228138

(51) Int. Cl.
*G03G 15/00* (2006.01)
*G03G 15/08* (2006.01)

(52) U.S. Cl.
CPC ..... *G03G 15/0865* (2013.01)

(58) Field of Classification Search
CPC ... G03G 9/0819; G03G 9/08; G03G 9/08733; G03G 15/0865; G03G 15/0867
USPC ..... 399/119, 258, 261, 262
See application file for complete search history.

(56) References Cited

U.S. PATENT DOCUMENTS 4,931,838 A 6/1990 Ban et al.
5,491,542 A 2/1996 Nagashima et al.
5,778,282 A 7/1998 Nagashima
6,049,685 A 4/2000 Murakami et al.
6,118,957 A 9/2000 Fujiwara et al.
6,118,958 A 9/2000 Nagashima
6,128,453 A 10/2000 Ban et al.
6,178,302 B1 1/2001 Nagashima et al.
6,219,506 B1 4/2001 Morinaga et al.
6,278,853 B1 8/2001 Ban et al.
6,501,924 B2 12/2002 Nagashima
RE38,737 E 5/2005 Ban et al.
6,909,865 B2 6/2005 Nagashima et al.
6,978,107 B2 12/2005 Nagashima et al.
7,050,728 B2 5/2006 Minagawa et al.
7,242,893 B2 7/2007 Murakami et al.
7,738,818 B2 6/2010 Murakami et al.
7,742,724 B2 6/2010 Tazawa et al.

(Continued)

FOREIGN PATENT DOCUMENTS

JP 2010-256893 A 11/2010

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

A developer supply container, the developer supply container includes a developer accommodating chamber; a rotatable feeding portion; a developer discharging chamber including a discharge opening; a driving force receiving portion for receiving a rotational force for rotating the feeding portion; an pump capable of changing an inside volume of the accommodating chamber in a longitudinal direction of the container to apply a pressure to the discharge opening; a driving force converter for converting the rotational force into a feeding driving force for feeding the developer by an operation of the pump in a longitudinal direction of the container; and wherein an expansion and contraction stroke of the pump provided by the converter in a initial predetermined number of rotations in a initial stage is different from that in a subsequent stage after the initial stage.

8 Claims, 16 Drawing Sheets

(56) References Cited

U.S. PATENT DOCUMENTS

| | | | | |
|---|---|---|---|---|
| 8,000,614 | B2 | 8/2011 | Okino et al. | |
| 2012/0014713 | A1* | 1/2012 | Murakami | G03G 15/0865 399/119 |
| 2012/0014722 | A1* | 1/2012 | Okino | G03G 15/0867 399/262 |
| 2015/0378278 | A1 | 12/2015 | Kamura et al. | |
| 2016/0004185 | A1 | 1/2016 | Enokuchi et al. | |
| 2016/0004186 | A1 | 1/2016 | Jimba et al. | |
| 2016/0004187 | A1 | 1/2016 | Yomoda et al. | |
| 2016/0004188 | A1 | 1/2016 | Kamura et al. | |
| 2016/0011540 | A1 | 1/2016 | Yamaoka et al. | |

* cited by examiner

DEVELOPER SUPPLY CONTAINER, DEVELOPER SUPPLYING APPARATUS AND IMAGE FORMING APPARATUS

FIELD OF THE INVENTION AND RELATED ART

The present invention relates to a developer supply container detachably mountable to a developer supplying device and also relates to the developer supplying apparatus and an image forming apparatus using the same. The developer supplying apparatus is used with an image forming apparatus such as a copying machine, a facsimile machine, a printer or a complex machine having functions of a plurality of such machines.

Conventionally, an image forming apparatus such as an electrophotographic copying machine uses a developer of fine particles. In such an image forming apparatus, the developer is supplied from a supply container (developer supply container) in response to consumption thereof resulting from image forming operation. Such a supply container is disclosed in Japanese Laid-open Patent Application 2010-256893, for example.

The apparatus disclosed in Japanese Laid-open Patent Application 2010-256893 employs a system in which the developer is discharged using a bellow pump provided in the supply container. More particularly, the bellow pump is expanded to provide a pressure lower than the ambient pressure in the supply container, so that the air is taken into the supply container to fluidize the developer. In addition, the bellow pump is contracted to provide a pressure higher than the ambient pressure in the supply container, so that the developer is pushed out by the pressure difference between the inside and the outside of the supply container, thus discharging the developer. By repeating the two steps alternately, the developer is stably discharged. In the supply container, the rotation received from the image forming apparatus is converted to a reciprocation to drive a bellow-like pump. With such a structure, the developer can be stably discharged out of the supply container.

However, with the structure of Japanese Laid-open Patent Application 2010-256893, a developer discharging efficiency immediately after the use amount of the developer supply container into the image forming apparatus may be low because of the situation before the developer supply container reaches the user.

SUMMARY OF THE INVENTION

Accordingly, it is a object of the present invention to provide a developer supply container, a developer supplying device and an image forming apparatus with which the developer can be easily discharged from the developer supply container to immediately after the use amount the developer supply container into the image forming apparatus.

According to an aspect of the present invention, there is provided a developer supply container detachably mountable to a developer supplying device, said developer supply container comprising: a developer accommodating chamber capable of accommodating a developer; a rotatable feeding portion configured to feed the developer in said developer accommodating chamber; a developer discharging chamber including a discharge opening for permitting discharge of the developer fed by said feeding portion; a driving force receiving portion configured to receive a rotational force for rotating said feeding portion; an pump portion capable of changing an inside volume of said developer accommodating chamber in a longitudinal direction of said developer supply container to apply a pressure at least to said discharge opening; a driving force converting portion configured to convert the rotational force received by said driving force receiving portion into a feeding driving force for feeding the developer by an operation of said pump portion in a longitudinal direction of said developer supply container; and wherein an expansion and contraction stroke of said pump portion provided by said driving force converting portion in a initial predetermined number of rotations in a initial stage is different from that in a subsequent stage after the initial stage.

Further features of the present invention will become apparent from the following description of exemplary embodiments with reference to the attached drawings.

Figure 2:
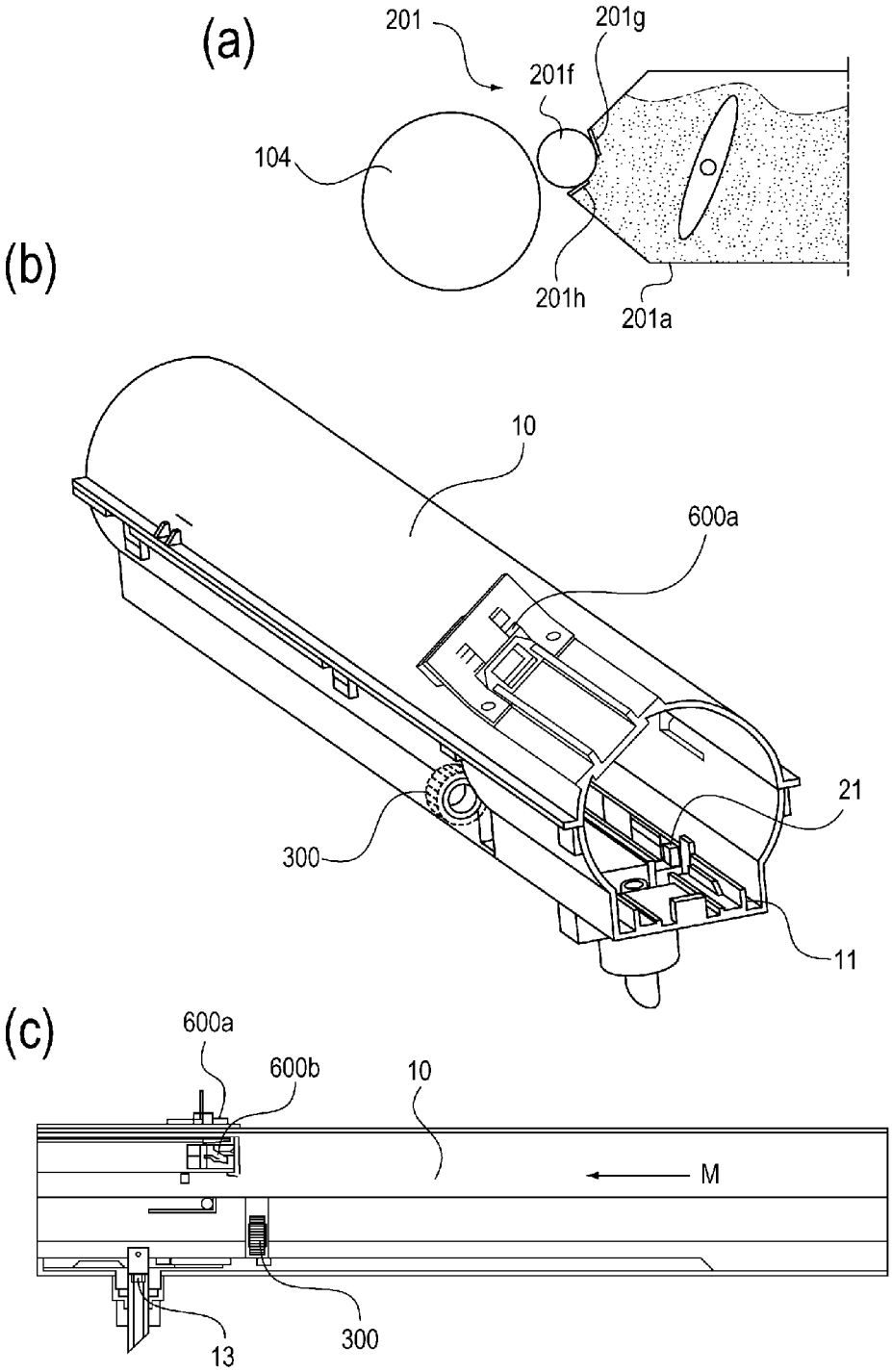

Part (a) of FIG. 2 is a partially sectional view of the developer supplying apparatus, (b) is a perspective view of a mounting portion for mounting the supply container, and (c) is a sectional view of the mounting portion.

Figure 3:
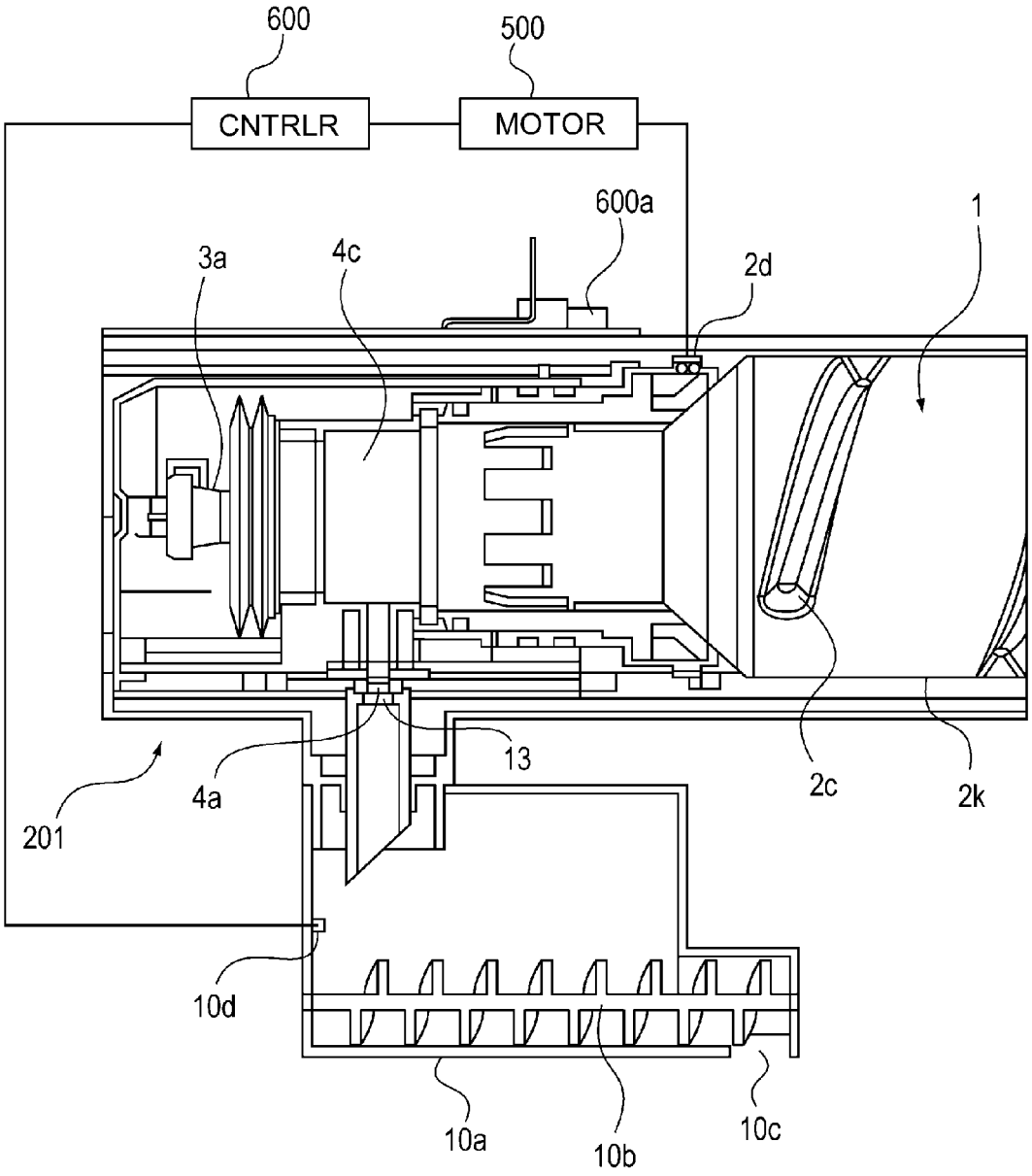

FIG. 3 shows a control system and a partially enlarged view of the supply container and the supplying device.

Figure 4:
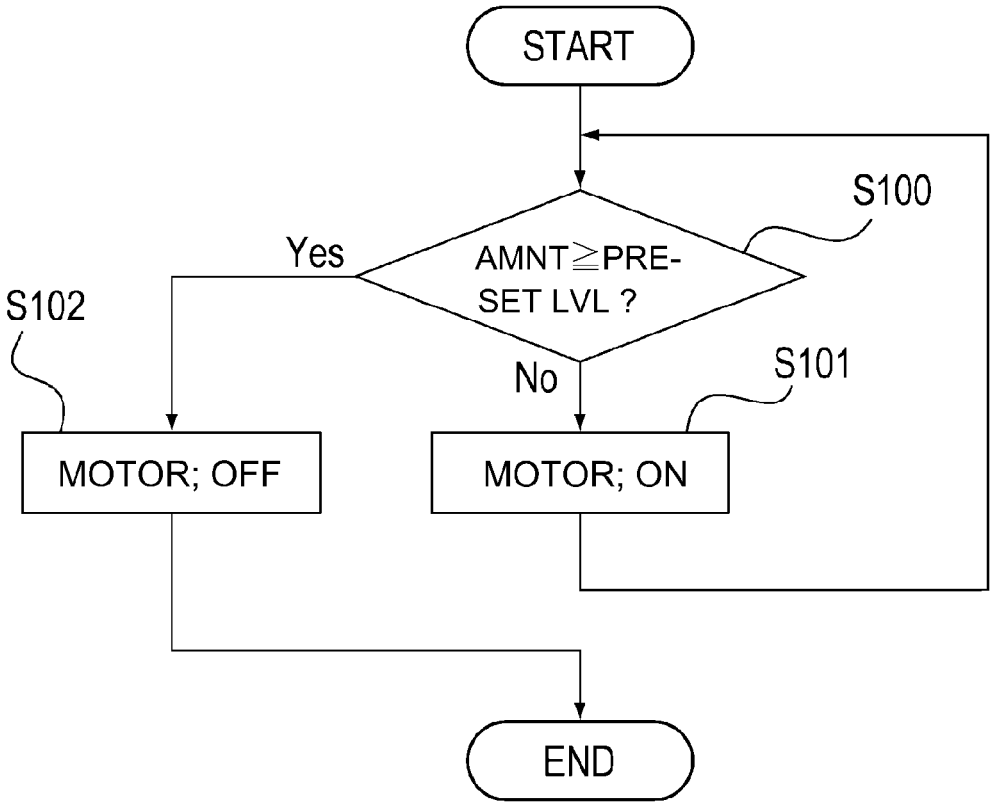

FIG. 4 is a flow chart illustrating a flow of developer supply operation controlled by the control system.

Figure 5:
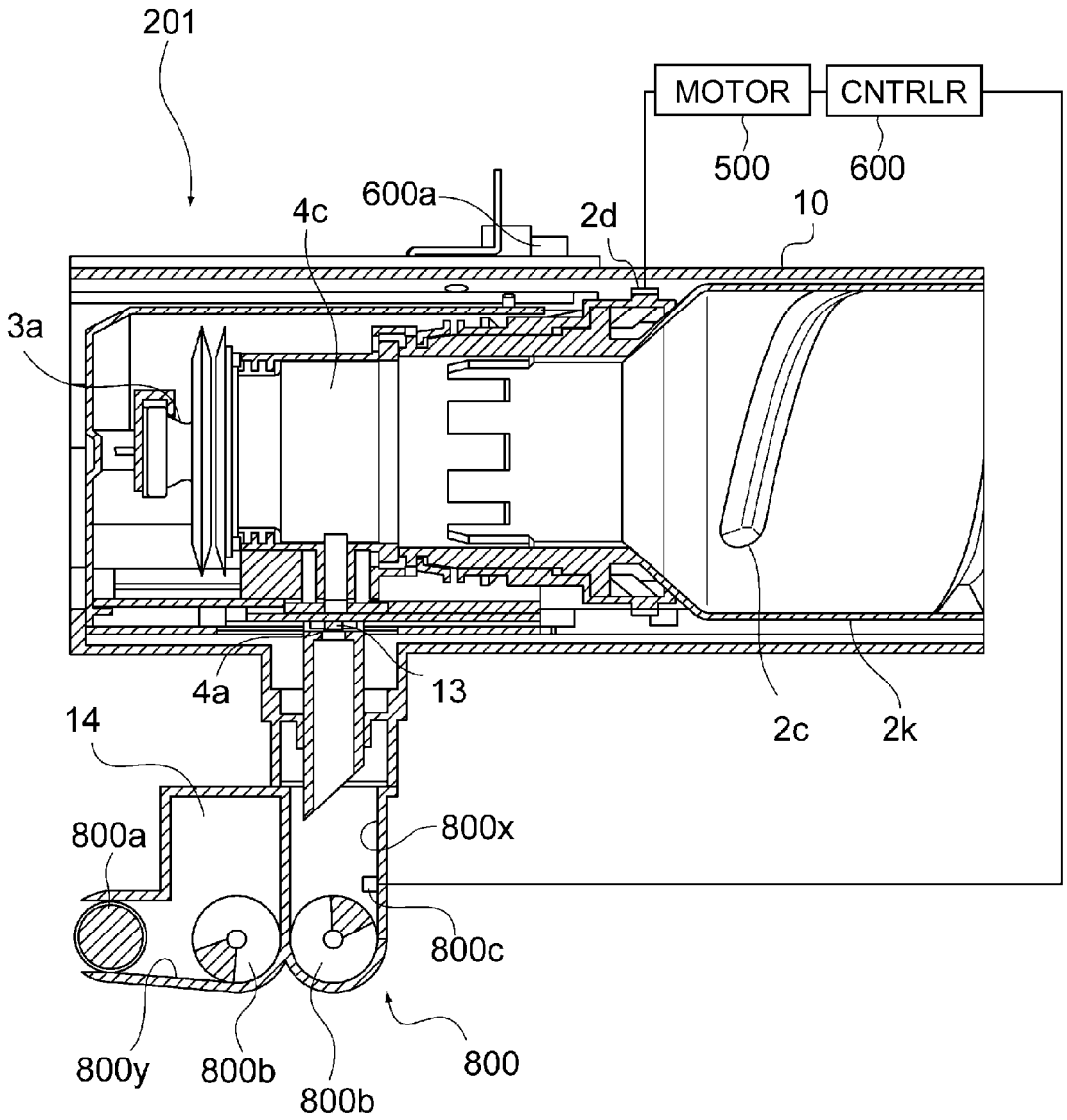

FIG. 5 is a sectional view illustrating a structure in which the developer is supplied directly (without use of a hopper) into a developing device from the supply container.

Figure 6:
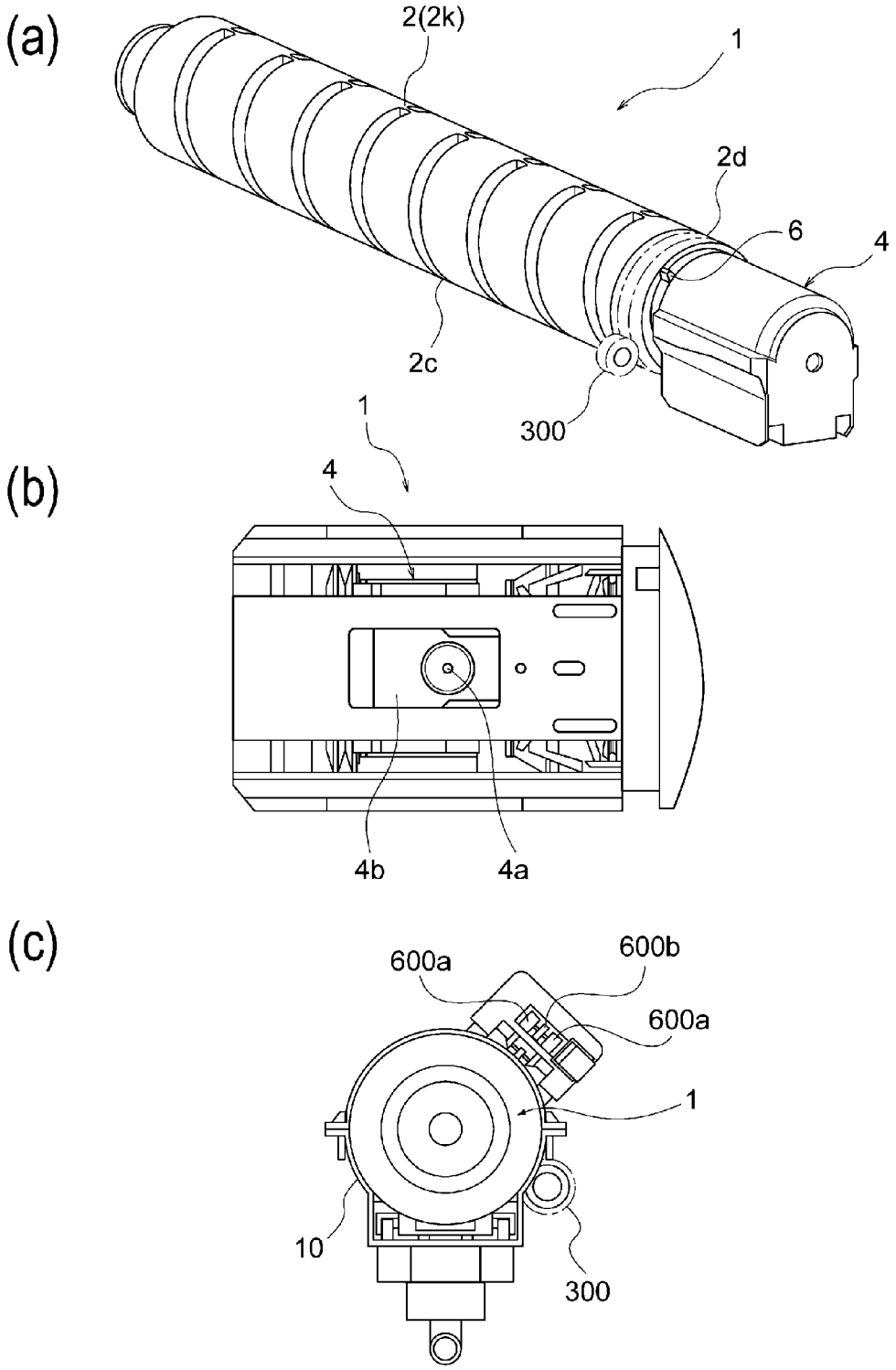

FIG. 6 (*a*) is a perspective view of an entirety of the supply container, FIG. 6 (*b*) is a partially enlarged view of the elements around a discharge opening of the supply container, FIG. 6 (*c*) is a front view illustrating a state in which the supply container is mounted to the mounting portion.

Figure 7:
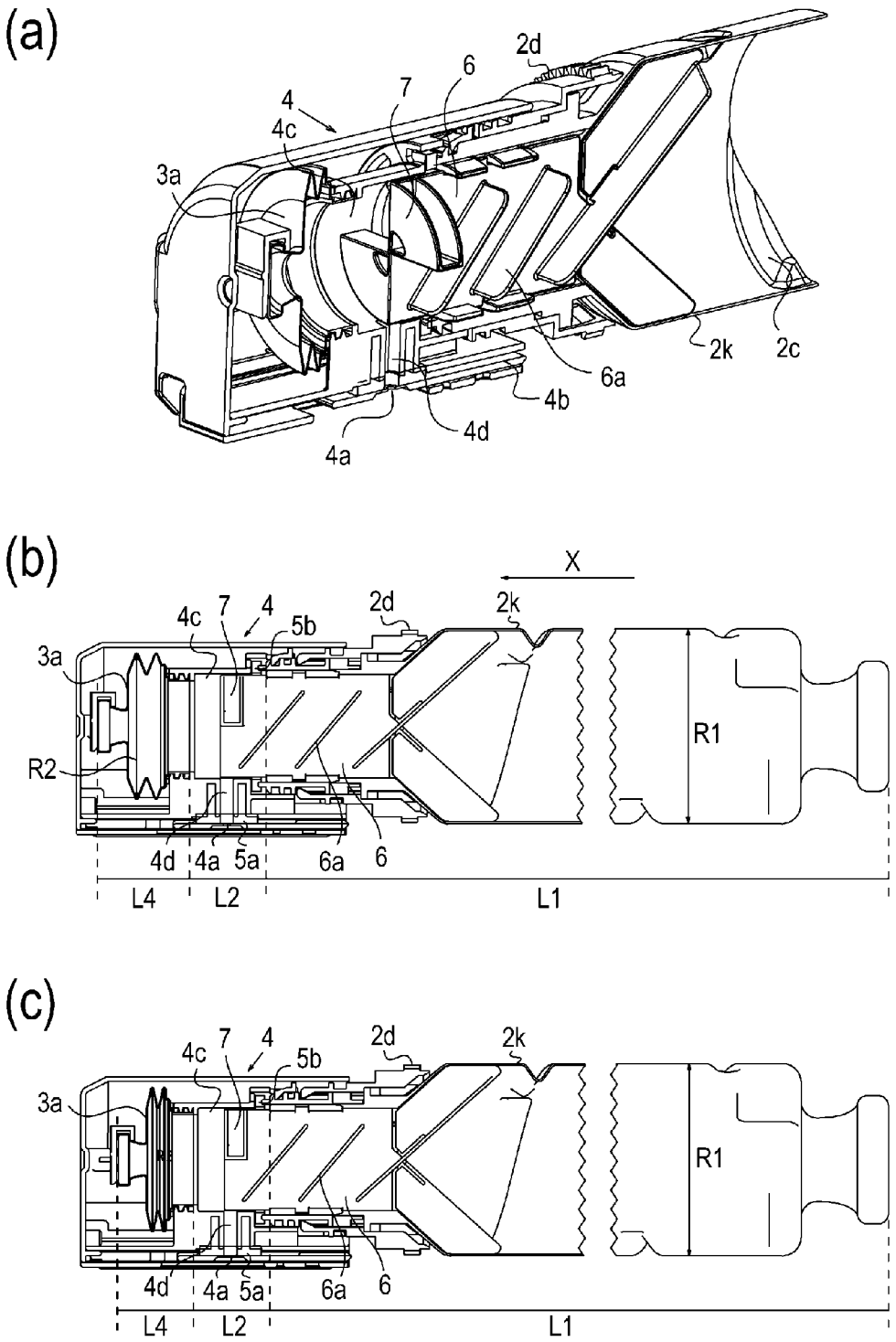

Part (a) of FIG. 7 is a sectional perspective view of the supply container, (b) is a partially sectional view in a state in which the pump portion is expanded to the maximum usable limit, and (c) is a partially sectional view in a state in which the pump portion is contracted to the maximum usable limit.

Figure 8:
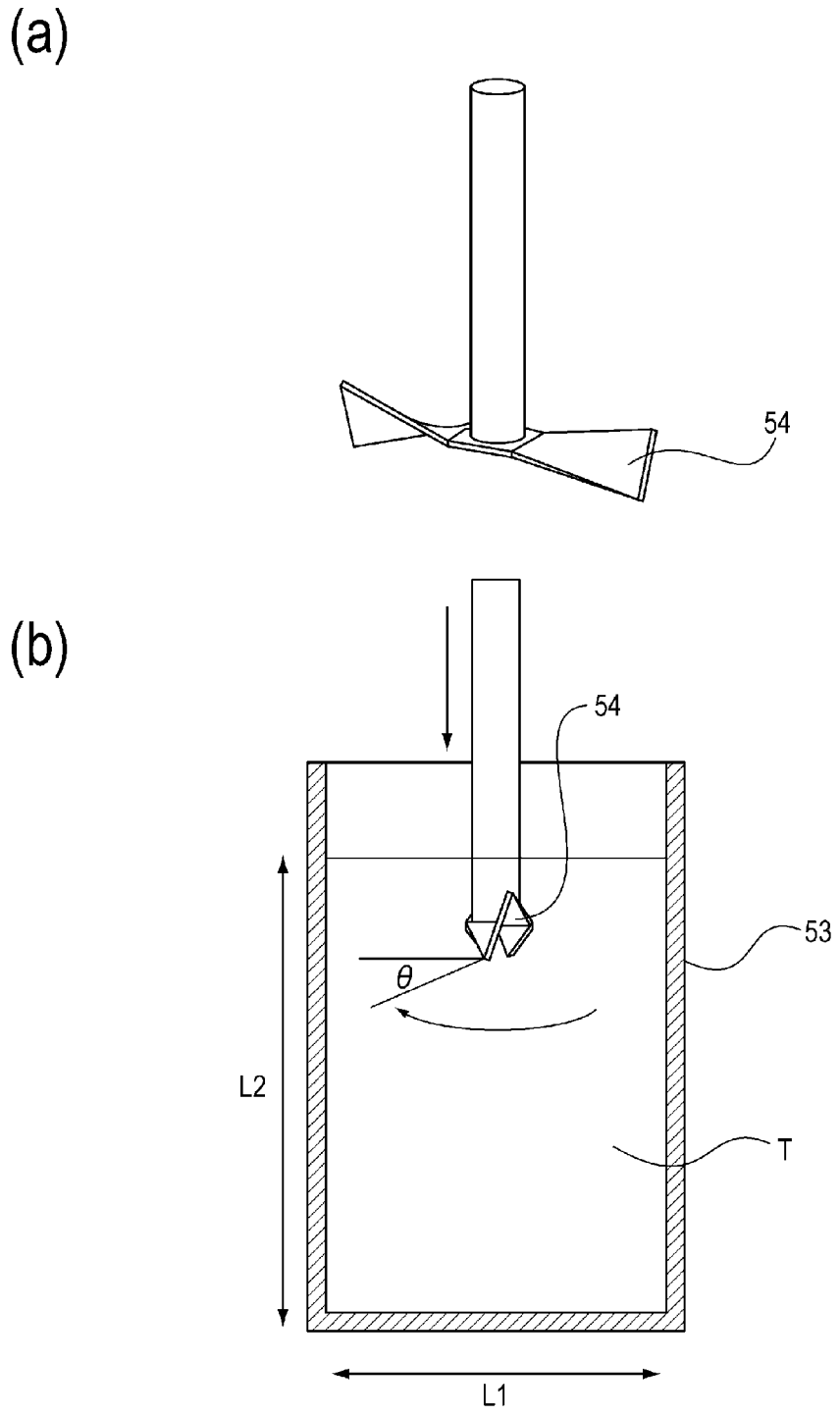

Parts (a) and (b) of FIG. 8 are schematic views of a device for measuring fluidity energy.

Figure 9:
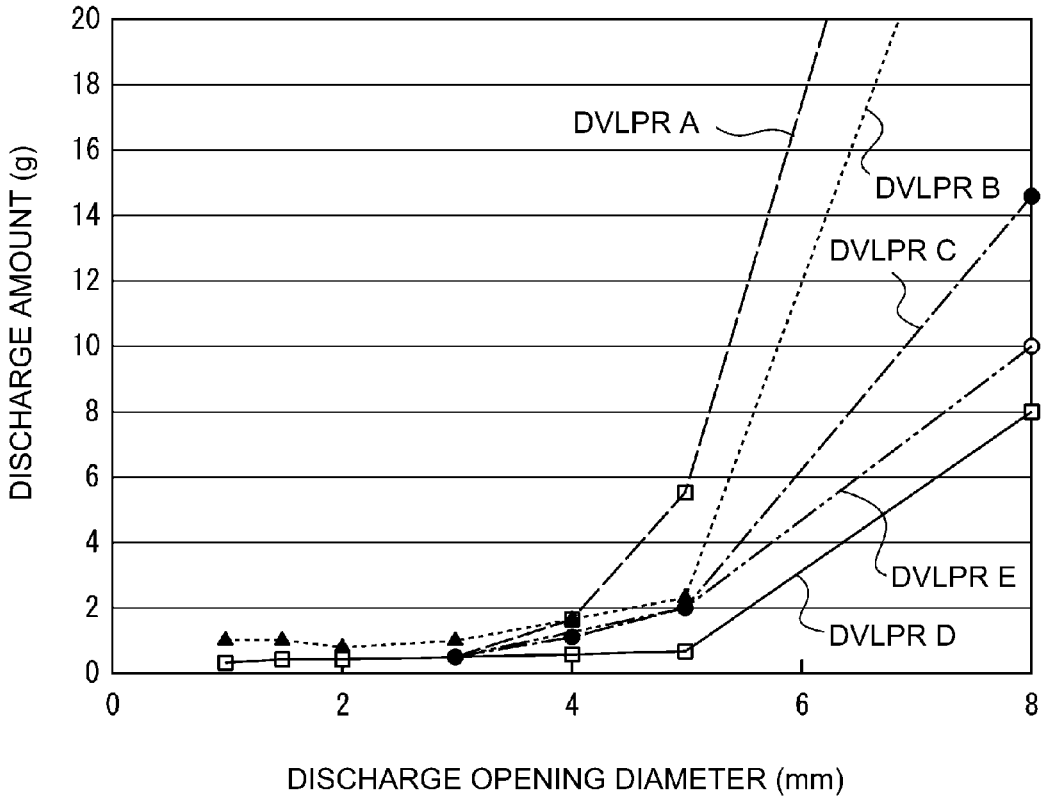

FIG. 9 is a graph showing a relation between a diameter of a discharge opening and a discharge amount, for various developers.

Figure 10:
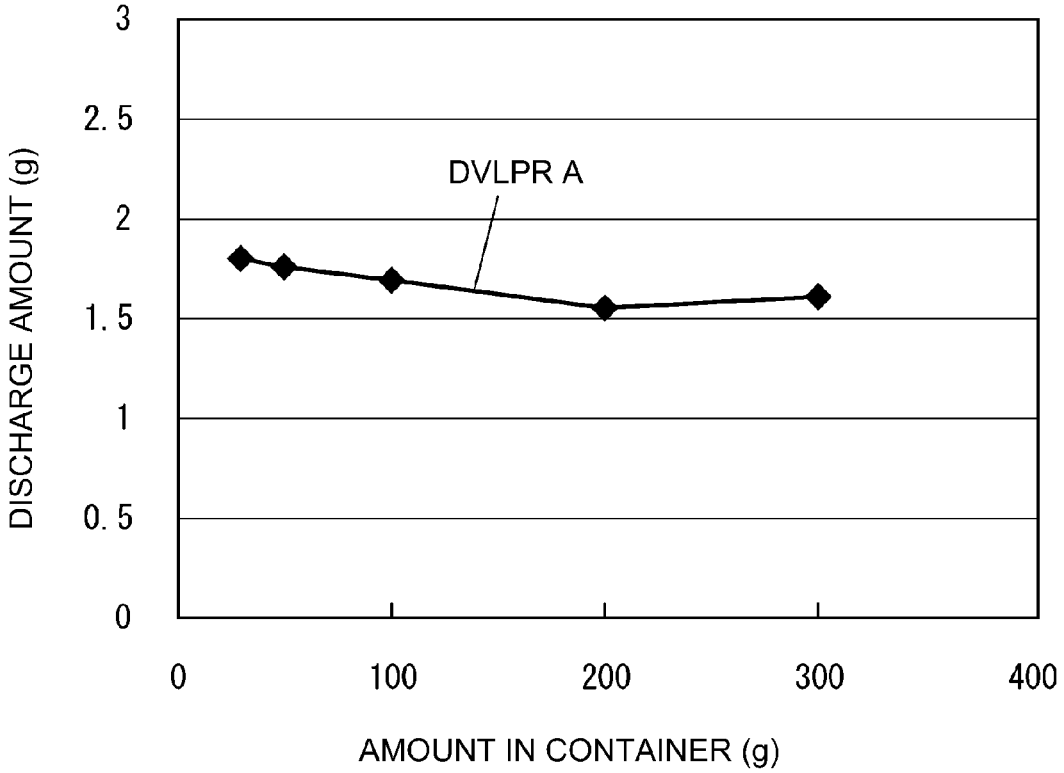

FIG. 10 shows a relationship between a developer discharge amount and an amount of the developer in the container, for the developer T.

Figure 11:
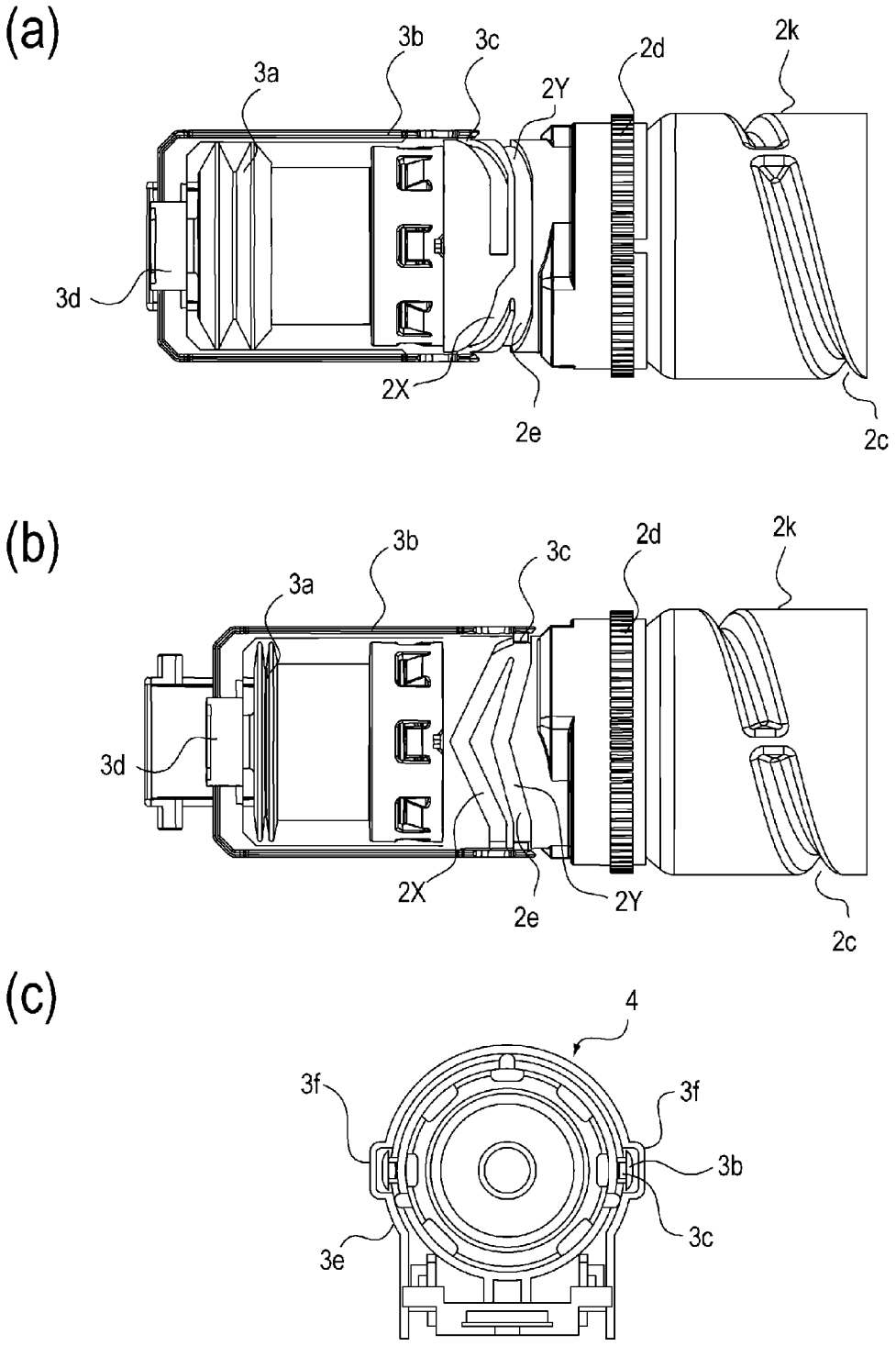

Part (a) of FIG. 11 is a partial view in a state in which the pump portion is expanded to the maximum usable limit, (b) is a partial view in a state in which the pump portion is contracted to the maximum usable limit, and (c) is a partial view of the pump portion.

Figure 12:
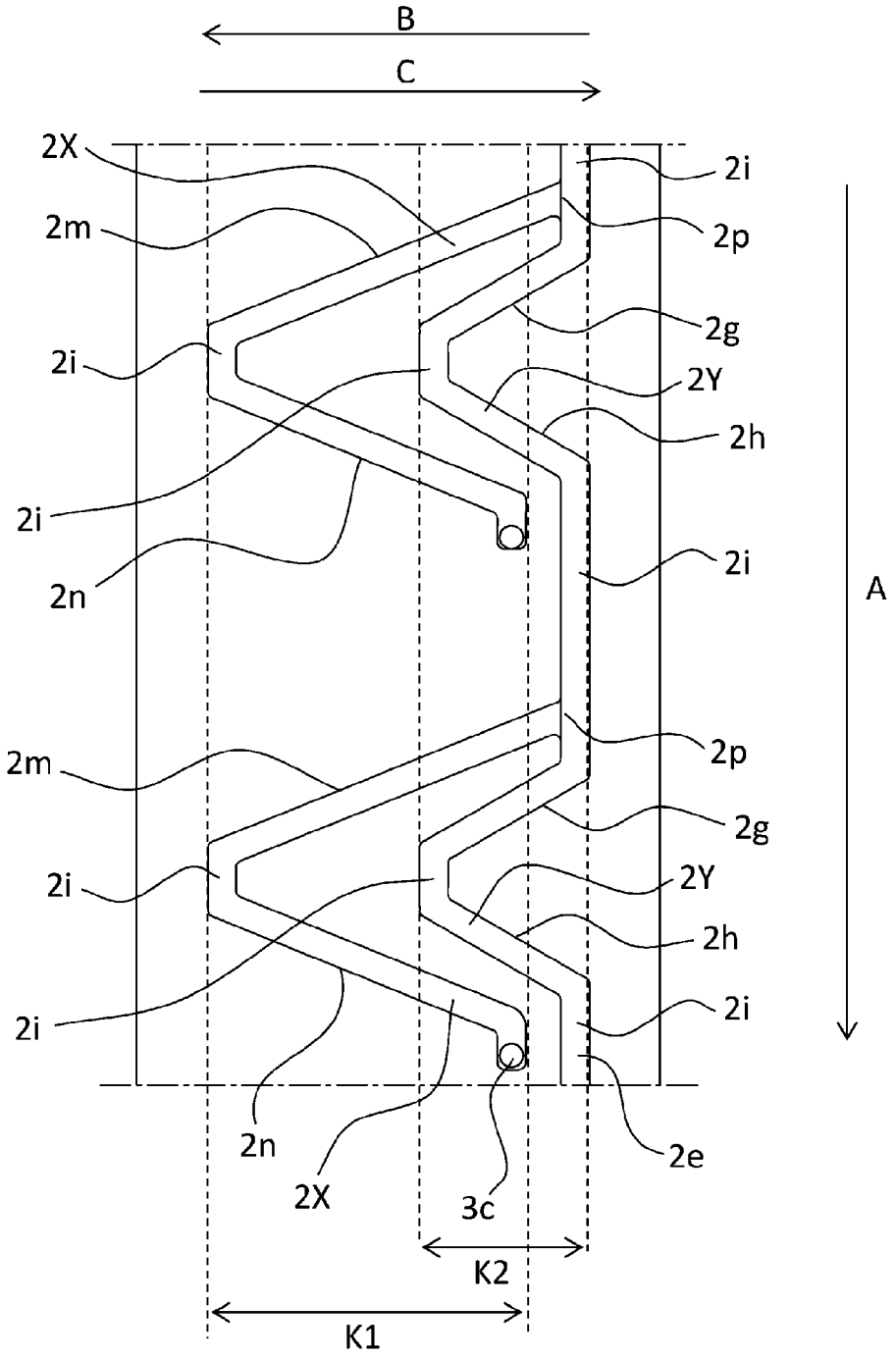

FIG. 12 is a top plan view illustrating a first cam groove and a second cam groove.

Figure 13:
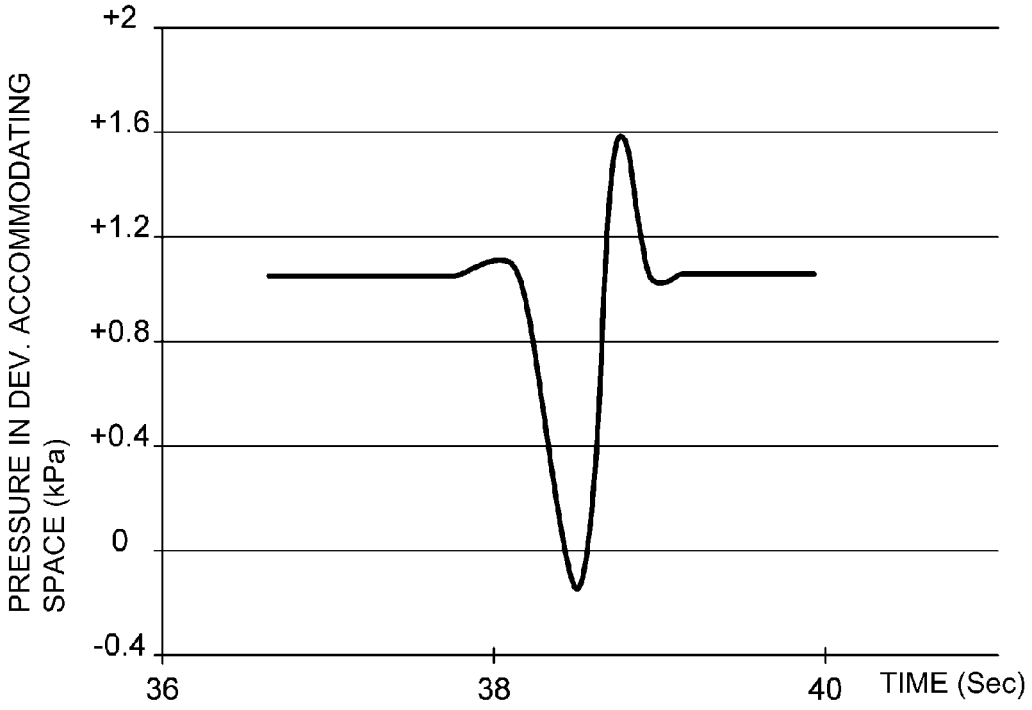

FIG. 13 illustrates a change of a internal pressure of the supply container filled with the developer, when the pump portion carried out expanding-and-contracting operation in the state that the shutter is opened to provide a communicating state between the supply container and the outside air through the discharge opening.

Figure 14:
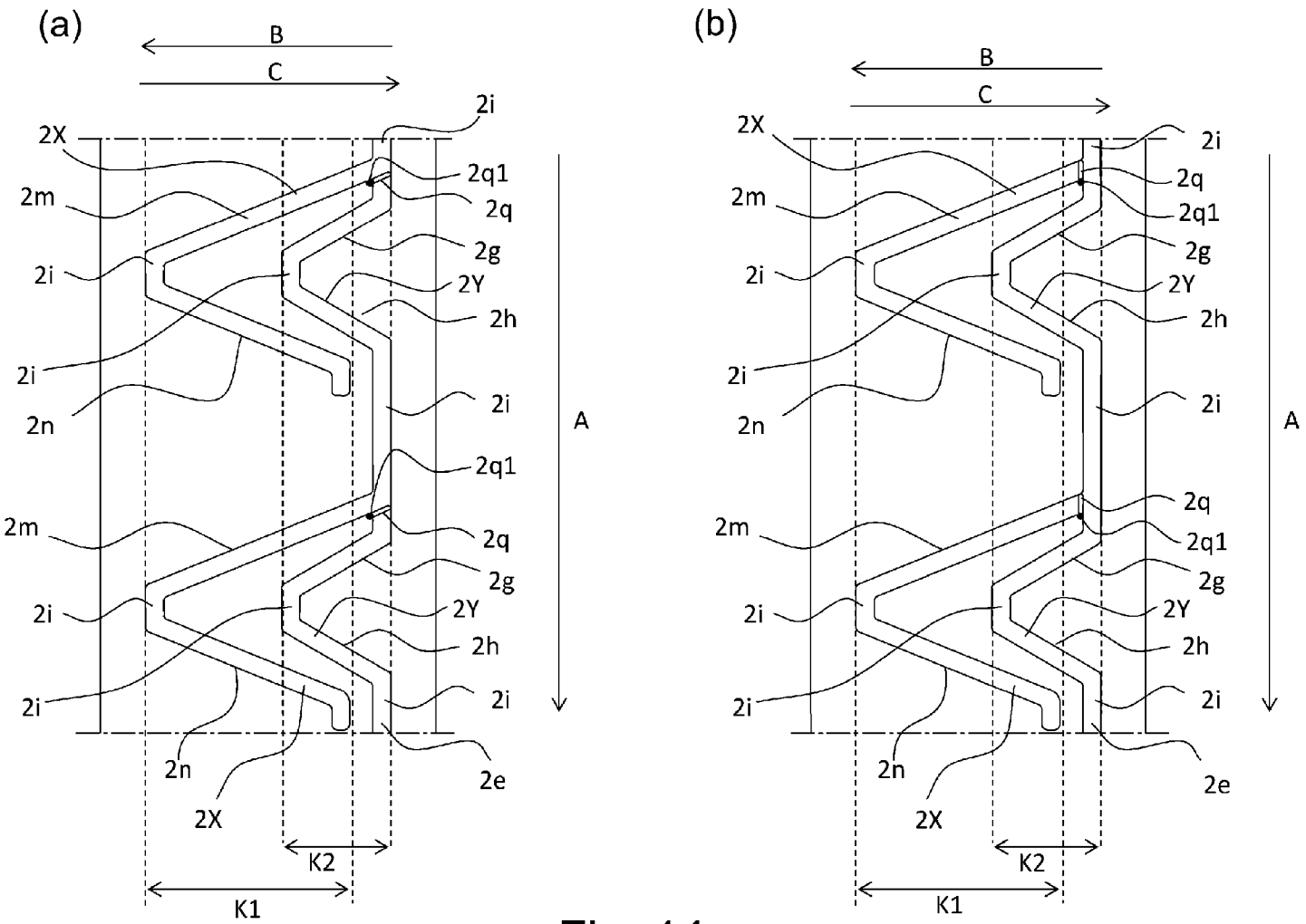

FIG. 14 is a development plan illustrating a structure of the first and second cam grooves according to a modified example.

Figure 15:
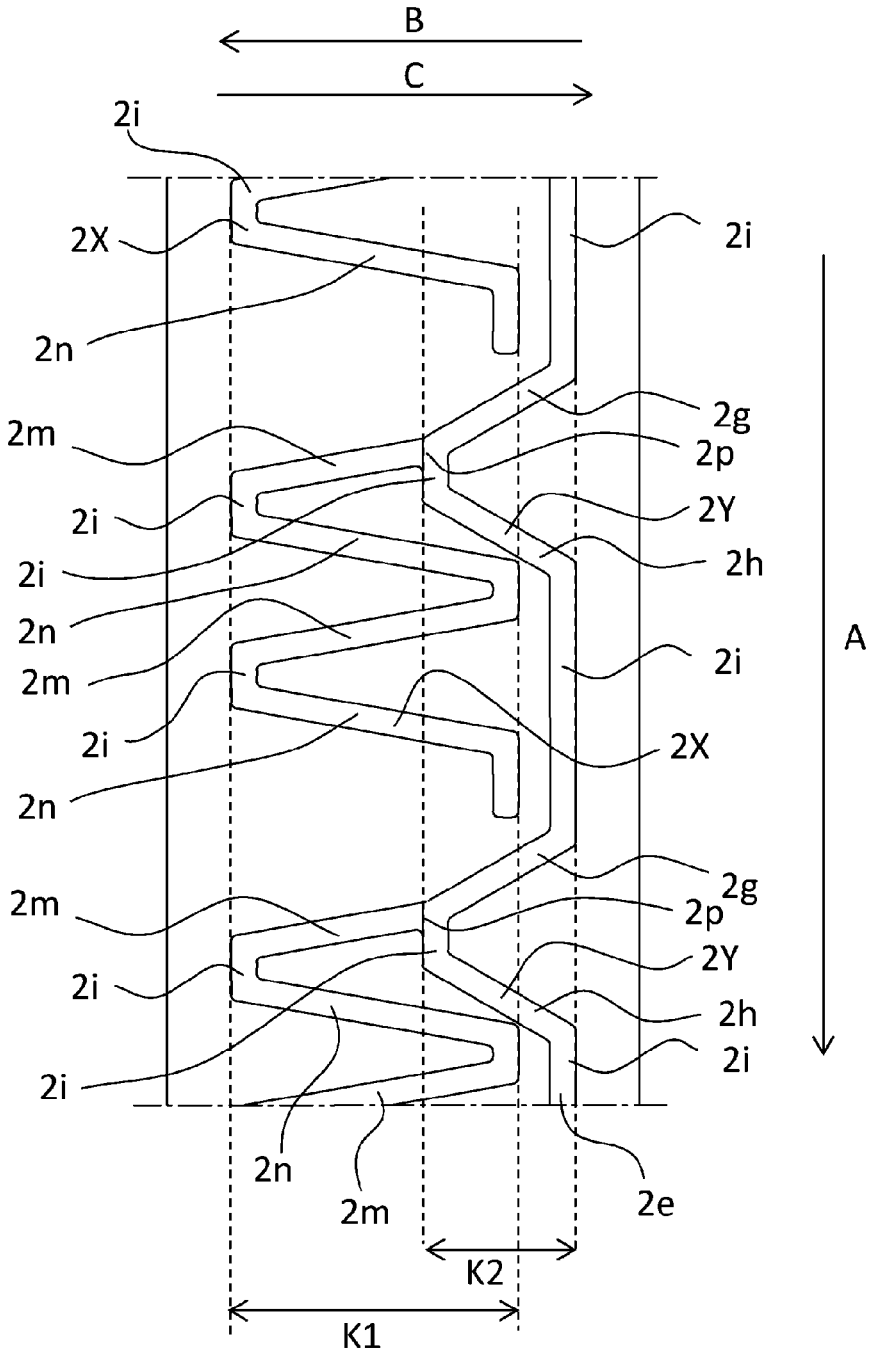

FIG. 15 is a sectional view of the first and second cam grooves according to the modified example.

Figure 16:
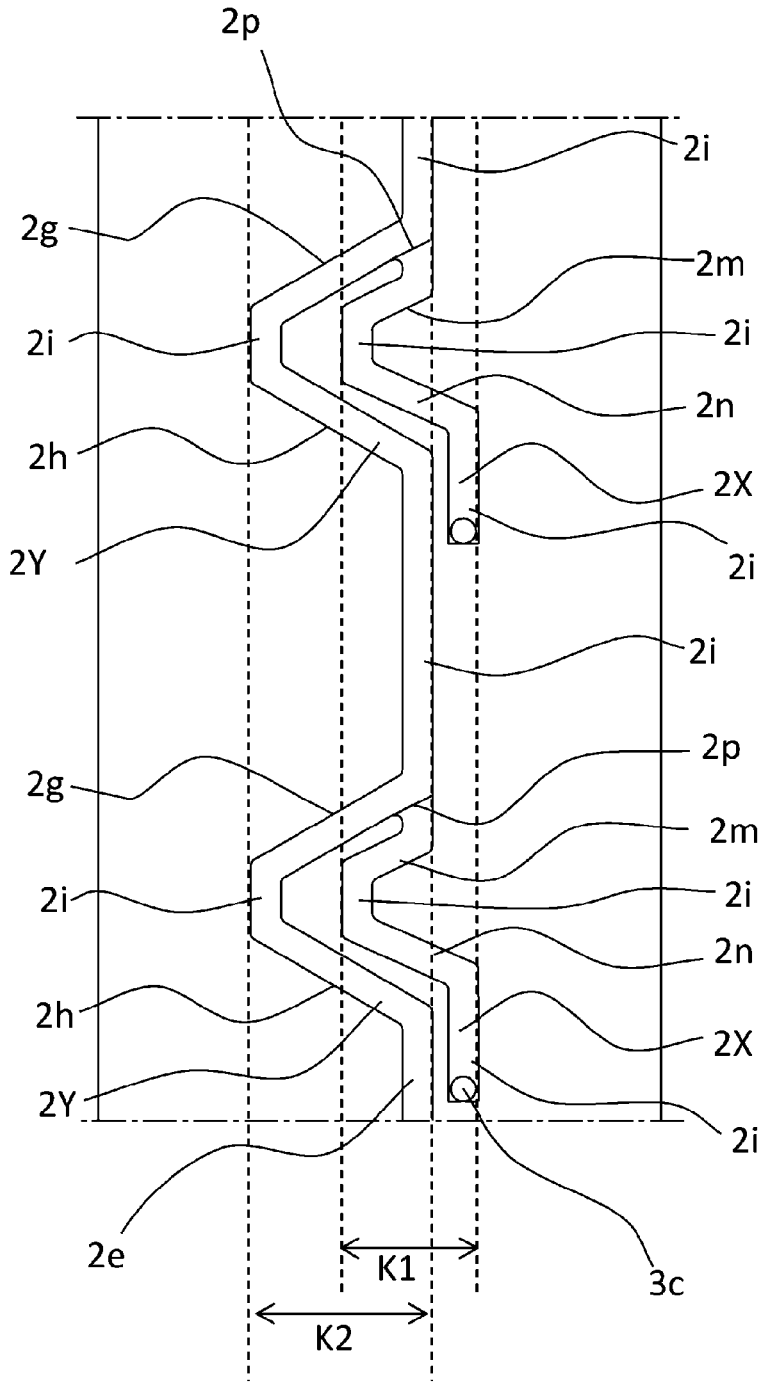

FIG. 16 is a sectional view of the first and second cam grooves according to an embodiment 2.

DESCRIPTION OF THE EMBODIMENTS

Embodiments of the present invention will be described in detail in conjunction with the accompanying drawings. The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated. In the description of the embodiments, the same reference numerals as in the previous embodiment are assigned to the elements having the corresponding functions in this embodiment, and the detailed description thereof is omitted for simplicity.

Embodiment 1

First, basic structures of an image forming apparatus will be described, and then, a developer supplying system, that is, a developer replenishing apparatus and a supply container used in the image forming apparatus will be described.

(Image Forming Apparatus)

Figure 1:
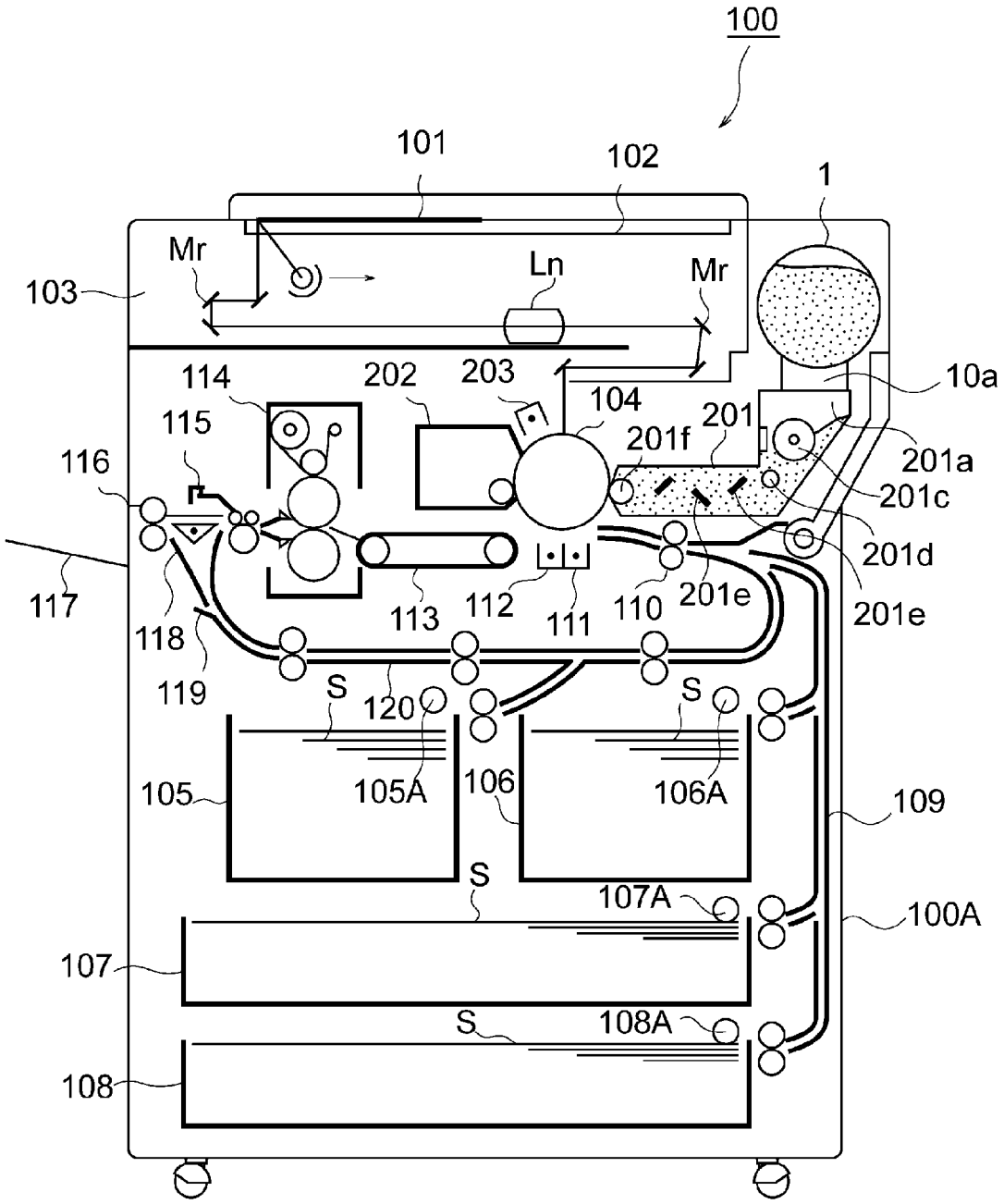
FIG. 1 is a sectional view of an image forming apparatus according to Embodiment 1.

FIG. 1 is a sectional view of an image forming apparatus 100 according to Embodiment 1 The image forming apparatus 100 is an example of an electrophotographic type copying machine (electrophotographic image forming apparatus) and is provided with a supplying device 201 to which a supply container 1 (so-called toner cartridge) is detachably mountable (demountable). The supply container 1 as the "developer supply container" is detachably mountable to the supplying device 201 as "developer supplying apparatus", that is, detachably mountable to a main assembly 100A of the image forming apparatus. Therefore, when the supply container 1 and/or the supplying device 201 is in the form of a cartridge, the cartridge is detachably mounted to the main assembly 100A.

The image forming apparatus 100 comprises the main assembly 100A. An original 101 is placed on an original supporting platen glass 102. A light image corresponding to image information of the original is imaged on an electrophotographic photosensitive drum 104 as an image bearing member by way of a plurality of mirrors M of an optical portion 103 and a lens Ln, so that an electrostatic image is formed. The electrostatic image is visualized with toner (one component magnetic toner) as a developer (dry powder) by a dry type developing device (one component developing device) 201*a*.

In this embodiment, the one component magnetic toner is used as the developer to be supplied from a supply container 1, but the present invention is not limited to the example and includes other examples which will be described hereinafter. Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

Cassettes 105-108 accommodates recording materials (sheets) S. Of the sheet S stacked in the cassettes 105-108, an optimum cassette is selected on the basis of a sheet size of the original 101 or information inputted by the operator (user) from a liquid crystal operating portion of the copying machine. The recording material is not limited to a sheet of paper, but OHP sheet or another material can be used as desired. One sheet S supplied by a separation and feeding device 105A-108A is fed to registration rollers 110 along a feeding portion 109, and is fed at timing synchronized with rotation of a photosensitive drum 104 and with scanning of an optical portion 103.

Below the photosensitive drum 104, there are provided a transfer charger 111 and a separation charger 112. An image of the developer formed on the photosensitive drum 104 is transferred onto the sheet S by a transfer charger 111. Then, the sheet S carrying the developed image (toner image) transferred thereonto is separated from the photosensitive drum 104 by the separation charger 112.

Thereafter, the sheet S fed by the feeding portion 113 is subjected to heat and pressure in a fixing portion 114 so that the developed image on the sheet is fixed, and then passes through a discharging/reversing portion 115, in the case of one-sided copy mode, and subsequently the sheet S is discharged to a discharging tray 117 by discharging rollers 116.

In the case of a duplex copy mode, the sheet S enters the discharging/reversing portion 115 and a part thereof is ejected once to an outside of the main assembly 100A by the discharging roller 116. The trailing end thereof passes through a flapper 118, and a flapper 118 is controlled when it is still nipped by the discharging rollers 116, and the discharging rollers 116 are rotated reversely, so that the sheet S is refed into the main assembly 100A. Then, the sheet S is fed to the registration rollers 110 by way of re-feeding portions 119, 120, and then conveyed along the path similarly to the case of the one-sided copy mode and is discharged to the discharging tray 117.

In the main assembly 100A, around the photosensitive drum 104, there are provided image forming process equipment (process means) such as a developing device 201*a* as the developing means a cleaner portion 202 as a cleaning means, a primary charger 203 as charging means. The developing device 201*a* develops the electrostatic latent image formed on the photosensitive drum 104 by the optical portion 103 in accordance with image information of the 101, by depositing the developer (toner) onto the latent image. The primary charger 203 functions to uniformly charge the surface of the photosensitive drum 104 so that an intended electrostatic image is formed on the photosensitive drum 104. In addition, the cleanup portion 202 is to remove the developer remaining on the photosensitive drum 104.

(Supplying Device)

Part (a) of FIG. 2 is a partially sectional view of the developer supplying apparatus, (b) is a perspective view of a mounting portion, and (c) is a sectional view of the mounting portion. FIG. 3 is partly enlarged sectional views of a control system, the supply container 1 and the developer replenishing apparatus 201. FIG. 4 is a flow chart illustrating a flow of developer supply operation controlled by the control system. Referring to FIGS. 1-4, the supplying device 201 which is a constituent-element of the developer supplying system will be described. The supply container 1 as the "developer supply container" is detachably mountable to the supplying device 201 as the "developer supplying apparatus".

As shown in FIG. 1, the developer replenishing apparatus 201 comprises the mounting portion (mounting space) 10, to which the supply container 1 is mounted demountably, a hopper 10*a* for storing temporarily the developer discharged from the supply container 1, and the developing device 201*a*. As shown in part (c) of FIG. 2, the supply container 1 is mountable in a direction indicated by an arrow M to the mounting portion 10. Thus, a longitudinal direction (rotational axis direction) of the supply container 1 is substantially the same as the direction of arrow M. The direction of arrow M is substantially parallel with a direction indicated by X of part (b) of FIG. 7 which will be described hereinafter. In addition, a dismounting direction of the supply container 1 from the mounting portion 10 is opposite the direction (inserting direction) of the arrow M.

As shown in parts (a) of FIGS. 1 and 2, the developing device 201*a* comprises a developing roller 201*f* as the "developer carrying member" for carrying the developer, a stirring member 201*c*, and feeding members 201*d* and 201*e*. The developer supplied from the supply container 1 is stirred by the stirring member 201*c*, is fed to the developing roller 201*f* by the magnet roller 201*d* and the feeding member 201*e*, and is supplied to the photosensitive drum 104 by the developing roller 201*f*.

A developing blade 201 *g* for regulating an amount of developer coating on the roller is provided relative to the developing roller 201*f*, and a leakage preventing sheet 201*h* is provided contacted to the developing roller 201*f* to prevent leakage of the developer between the developing device 201*a* and the developing roller 201*f*.

As shown in part (b) of FIG. 2, the mounting portion 10 is provided with a rotation regulating portion (holding mechanism) 11 for limiting movement of the flange portion 4 in the rotational moving direction by abutting to a flange portion 4 (FIG. 6) of the supply container 1 when the supply container 1 is mounted.

Furthermore, the mounting portion 10 is provided with a developer receiving port (developer reception hole) 13 (FIG. 3) for receiving the developer discharged from the supply container 1, and the developer receiving port is brought into fluid communication with a discharge opening (discharging port) 4*a* (FIG. 6) of the supply container 1 which will be described hereinafter, when the supply container 1 is mounted thereto. The developer is supplied from the discharge opening 4*a* of the supply container 1 to the hopper 10*a* through the developer receiving port 13. In this embodiment, a diameter ϕ of the developer receiving port 13 is approx. 2 mm (pin hole), for the purpose of preventing as much as possible the contamination by the developer in the mounting portion 10. The diameter of the developer receiving ports 13 may be any if the developer can be discharged through the discharge opening 4*a*.

As shown in FIG. 3, the hopper 10*a* comprises a feeding screw 10*b* for feeding the developer to the developing device 201*a* an opening 10*c* in fluid communication with the developing device 201*a* and a developer sensor 10*d* for detecting an amount of the developer accommodated in the hopper 10*a*.

As shown in parts (b) and (c) of FIG. 2, the mounting portion 10 is provided with a driving gear 300 functioning as a driving mechanism (driver). The driving gear 300 receives a rotational force from a driving motor 500 (FIG. 3) through a driving gear train, and functions to apply a rotational force to the supply container 1 which is set in the mounting portion 10.

As shown in FIG. 3, the driving motor 500 is controlled by a control device (CPU) 600. As shown in FIG. 3, the control device 600 controls the operation of the driving motor 500 on the basis of information indicative of a developer remainder inputted from the developer sensor 10*d*.

In this example, the driving gear 300 is rotatable unidirectionally to simplify the control for the driving motor 500. The control device 600 controls only ON (operation) and OFF (non-operation) of the driving motor 500. This simplifies the driving mechanism for the developer replenishing apparatus 201 as compared with a structure in which forward and backward driving forces are provided by periodically rotating the driving motor 500 (driving gear 300) in the forward direction and backward direction.

(Mounting/Dismounting Method of Supply Container)

The description will be made as to mounting/dismounting method of the supply container 1. First, the operator opens an exchange cover and inserts and mounts the supply container 1 to a mounting portion 10 of the developer replenishing apparatus 201. With the mounting operation, the flange portion 4 of the supply container 1 is held and fixed in the developer replenishing apparatus 201. Thereafter, the operator closes the exchange cover to complete the mounting step. Thereafter, the control device 600 controls the driving motor 500, by which the driving gear 300 rotates at proper timing.

On the other hand, when the supply container 1 becomes empty, the operator opens the exchange cover and takes the supply container 1 out of the mounting portion 10. The operator inserts and mounts a new supply container 1 prepared beforehand and closes the exchange cover, by which the exchanging operation from the removal to the remounting of the supply container 1 is completed.

(Developer Supply Control by Developer Replenishing Apparatus)

Referring to a flow chart of FIG. 4, a developer supply control by the developer replenishing apparatus 201 will be described. The developer supply control is executed by controlling various equipment by the control device (CPU) 600. In this example, the control device 600 controls the operation/non-operation of the driving motor 500 in accordance with an output of the developer sensor 10*d* by which the developer is not accommodated in the hopper 10*a* beyond a predetermined amount.

The developer sensor 10*d* checks the accommodated developer amount in the hopper 10*a* (S100). When the accommodated developer amount detected by the developer sensor 10*d* is discriminated as being less than a predetermined amount, that is, when no developer is detected by the developer sensor 10*d*, the driving motor 500 is actuated to execute a developer supplying operation for a predetermined time period (S101).

When the accommodated developer amount detected with developer sensor 10*d* is discriminated as having reached the predetermined amount, that is, when the developer is detected by the developer sensor 10*d*, as a result of the developer supplying operation, the control device 600 deactuates the motor 500 to stop the developer supplying operation (S102). By the stop of the supplying operation, a series of developer supplying steps is completed. Such developer supplying steps are carried out repeatedly whenever the accommodated developer amount in the hopper 10*a* becomes less than a predetermined amount as a result of consumption of the developer by the image forming operations.

FIG. 5 is a sectional view illustrating a structure in which the hopper 10*a* of FIG. 3 is omitted, and the developer is directly supplied to the developing device 800 from the supply container 1. In FIG. 3, the developer discharged from the supply container 1 is stored temporarily in the hopper 10*a*, and then is supplied into the developing device 201*a*, the supplying device 201 may have the structure of FIG. 5. FIG. 5 shows an example of a developing device 800 using two component developer supplied from the supplying device 201. The developing device 800 comprises a stirring chamber 800*x* into which the developer is stirred, and a developer chamber 800*y* for supplying the developer to the developing sleeve 800*a*, wherein the stirring chamber 800*x* and the developer chamber 800*y* are provided with stirring screws 800*b* rotatable in such directions that the developer is fed in the opposite directions from each other.

The stirring chamber 800$x$ and the developer chamber 800$y$ are communicated with each other in the opposite longitudinal end portions, and the two component developer are circulated the two chambers. The stirring chamber 800$x$ is provided with a magnetometric sensor 800$c$ for detecting a toner content of the developer, and on the basis of the detection result of the magnetometric sensor 800$c$, the control device 600 controls the operation of the driving motor 500. In such a case, the developer supplied from the supply container is non-magnetic toner or non-magnetic toner plus magnetic carrier.

In this example, as will be described hereinafter, the developer in the supply container 1 is hardly discharged through the discharge opening 4$a$ only by the gravitation, but the developer is discharged by a volume changing operation of a pump portion 3$b$, and therefore, variation in the discharge amount can be suppressed. Therefore, the supply container 1 which will be described hereinafter is usable for the example of FIG. 5 lacking the hopper 10$a$, and the supply of the developer into the developing chamber 800$y$ is stable with such a structure.

(Supply Container)

Referring to FIGS. 6 and 7, the structure of the supply container 1 which is a constituent-element of the developer supplying system will be described. Part (a) of FIG. 6 is a perspective view illustrating the supply container according to Embodiment 1 of the present invention, (b) is a partial enlarged view illustrating a state around a discharge opening, and (c) is a front view illustrating a state in which the supply container is mounted to the mounting portion of the developer supplying apparatus. Part (a) of FIG. 7 is a perspective view of a section of the supply container, Part (b) of FIG. 7 is a partially sectional view in a state in which the pump portion is expanded to the maximum usable limit, and (c) is a partially sectional view in a state in which the pump portion is contracted to the maximum usable limit.

As shown in part (a) of FIG. 6, the supply container 1 includes a developer accommodating portion 2 (container body) having a hollow cylindrical inside space for accommodating the developer. In this example, a cylindrical portion 2$k$, the discharging portion 4$c$ and the pump portion 3$b$ (FIG. 5) function as the developer accommodating portion 2. Furthermore, the supply container 1 is provided with a flange portion 4 (non-rotatable portion) at one end of the developer accommodating portion 2 with respect to the longitudinal direction (developer feeding direction). The cylindrical portion 2 is rotatable relative to the flange portion 4. A cross-sectional configuration of the cylindrical portion 2$k$ may be non-circular as long as the non-circular shape does not adversely affect the rotating operation in the developer supplying step. For example, it may be oval configuration, polygonal configuration or the like.

In this example, as shown in part (b) of FIG. 7, a total length L1 of the cylindrical portion 2$k$ functioning as the developer accommodating chamber is approx. 460 mm, and an outer diameter R1 is approx. 60 mm. A length L2 of the range in which the discharging portion 4$c$ functioning as the developer discharging chamber is approx. 21 mm. A total length L3 of the pump portion 3$b$ (in the state that it is most expanded in the expansible range in use) is approx. 40 mm. A total length L4 of the pump portion 3$a$ (in the state that it is most contracted in the expansible range in use) is approx. 24 mm.

As shown in FIGS. 6, 7, in this example, in the state that the supply container 1 is mounted to the developer replenishing apparatus 201, the cylindrical portion 2$k$ and the discharging portion 4$c$ are substantially on line along a horizontal direction. The cylindrical portion 2$k$ has a sufficiently long length in the horizontal direction as compared with the length in the vertical direction, and one end part with respect to the horizontal direction is connected with the discharging portion 4$c$. For this reason, an amount of the developer existing above the discharge opening 4$a$ which will be described hereinafter can be made smaller as compared with the case in which the cylindrical portion 2$k$ is above the discharging portion 4$c$ in the state that the supply container 1 is mounted to the developer replenishing apparatus 201. Therefore, the developer in the neighborhood of the discharge opening 4$a$ is less compressed, thus accomplishing smooth suction and discharging operation.

(Material of Supply Container)

In this example, as will be described hereinafter, the developer is discharged through the discharge opening 4$a$ by changing an internal volume of the supply container 1 by the pump portion 3$a$. Therefore, the material of the supply container 1 is preferably such that it provides an enough rigidity to avoid collision or extreme expansion against the volume change.

In addition, in this example, the supply container 1 is in fluid communication with an outside only through the discharge opening 4$a$, and is sealed except for the discharge opening 4$a$. Such a hermetical property as is enough to maintain a stabilized discharging performance in the discharging operation of the developer through the discharge opening 4$a$ is provided by the decrease and increase of the volume of supply container 1 by the pump portion 3$a$.

Under the circumstances, this example employs polystyrene resin material as the materials of the developer accommodating portion 2 and the discharging portion 4$c$ and employs polypropylene resin material as the material of the pump portion 3$a$. As for the material for the developer accommodating portion 2 and the discharging portion 4$c$, other resin materials such as ABS (acrylonitrile, butadiene, styrene copolymer resin material), polyester, polyethylene, polypropylene, for example are usable if they have enough durability against the volume change. Alternatively, they may be metal.

As for the material of the pump portion 3$a$, any material is usable if it is expansible and contractable enough to change the internal pressure of the supply container 1 by the volume change. The examples includes thin formed ABS (acrylonitrile, butadiene, styrene copolymer resin material), polystyrene, polyester, polyethylene materials. Alternatively, other expandable-and-contractable materials such as rubber are usable.

They may be integrally molded of the same material through an injection molding method, a blow molding method or the like if the thicknesses are properly adjusted for the pump portion 3$a$, developer accommodating portion 2 and the discharging portion 3$h$, respectively. In the following, the description will be made as to the structures of the flange portion 4, the cylindrical portion 2$k$, the pump portion 3$a$, the gear portion 2$d$, and a cam grooves 2X and 2Y.

(Flange Portion)

As shown in parts (a) and (b) of FIG. 7, the flange portion 4 is provided with a hollow discharging portion (developer discharging chamber) 4$c$ for temporarily accommodating the developer having been fed from the cylindrical portion 2$k$.

The discharge portion 4$c$ includes the discharge opening 4$a$ which permits discharge of the developer fed by the inclined ribs 6$a$. More particularly, a bottom portion of the discharging portion 4$c$ is provided with the small discharge opening 4$a$ for permitting discharge of the developer to the outside of the supply container 1, that is, for supplying the developer into the developer replenishing apparatus 201.

Above the discharge opening 4*a*, there is provided a storage portion 4*d* capable of storing a predetermined amount of the developer before the discharge thereof to provide communication between the discharge opening 4*a* and the inside of the supply container 1. The size of the discharge opening 4*a* will be described hereinafter.

The flange portion 4 is provided with a shutter 4*b* for opening and closing the discharge opening 4*a*. The shutter 4*b* is provided at a position such that when the supply container 1 is mounted to the mounting portion 10, it is abutted to an abutting portion 21 (see part (b) of FIG. 2) provided in the mounting portion 10. Therefore, the shutter 4*b* slides relative to the supply container 1 in the rotational axis direction (opposite from the arrow M direction of part (c) of FIG. 2) of the cylindrical 2*k* with the mounting operation of the supply container 1 to the mounting portion 10. As a result, the discharge opening 4*a* is exposed through the shutter 4*b*, thus completing the unsealing operation. At this time, the discharge opening 4*a* is positionally aligned with the developer receiving port 13 of the mounting portion 10, and therefore, they are brought into fluid communication with each other, thus enabling the developer supply from the supply container 1.

The flange portion 4 is constructed such that when the supply container 1 is mounted to the mounting portion 10 of the developer replenishing apparatus 201, it is stationary substantially. More particularly, a rotation regulating portion 11 shown in part (b) of FIG. 2 is provided so that the flange portion 4 does not rotate in the rotational direction of the cylindrical portion 2*k*. Therefore, in the state that the supply container 1 is mounted to the developer replenishing apparatus 201, the discharging portion 3*h* provided in the flange portion 3 is prevented substantially in the movement of the cylindrical portion 2*k* in the rotational moving direction (movement within the play is permitted). On the other hand, the cylindrical portion 2*k* is not limited in the rotational moving direction by the developer replenishing apparatus 201, and therefore, is rotatable in the developer supplying step.

In addition, as shown in as shown in part (a) of FIG. 7, a feeding member 6 in the form of a plate is provided to feed the developer fed from the cylindrical portion 2*k* by a helical projection (feeding projection) 2*c* to the discharging portion 4*c*. The feeding member 6 divides a part region of the developer accommodating portion 2 into substantially two parts, and integrally rotatable with the cylindrical portion 2*k*. The feeding member 6 is provided on each of the sides thereof with a plurality of inclination ribs 6*a* inclined toward the discharging portion 4*c* relative to the rotational axis direction of the cylindrical portion 2*k*. The inclination rib 6*a* as feeding portion rotates inside the cylindrical portion 2*k* to feed the developer. In the structure, an end portion of the feeding member 6 is provided with a regulating portion 7. In the details of the regulating portion 7 will be described hereinafter.

With the above-described structure, the developer fed by the feeding projection 2*c* is scooped up by the plate-like feeding member 6 in interrelation with the rotation of the cylindrical portion 2*k*. Thereafter, with the further rotation of the cylindrical portion 2*k*, the developer slides down on the surface of the feeding member 6 by the gravity, and sooner or later, the developer is transferred to the discharging portion 4*c* by the inclination ribs 6*a*. With this structure of this example, the inclination ribs 6*a* are provided on each of the sides of the feeding member 6 so that the developer is fed into the discharging portion 4*c* for each half of the full-turn of the cylindrical portion 2*k*.

(Discharge Opening of Flange Portion)

In this example, the size of the discharge opening 4*a* of the supply container 1 is so selected that in the orientation of the supply container 1 for supplying the developer into the developer replenishing apparatus 201, the developer is not discharged to a sufficient extent, only by the gravitation. The opening size of the discharge opening 4*a* is so small that the discharging of the developer from the supply container is insufficient only by the gravitation, and therefore, the opening is called pin hole hereinafter. In other words, the size of the opening is determined such that the discharge opening 4*a* is substantially clogged. This is expectedly advantageous in the following points:

(1) the developer does not easily leak through the discharge opening 4*a*. (2) excessive discharging of the developer at time of opening of the discharge opening 4*a* can be suppressed. (3) the discharging of the developer can rely dominantly on the discharging operation by the pump portion 3*a*. The inventors have investigated as to the size of the discharge opening 4*a* not enough to discharge the toner to a sufficient extent only by the gravitation. The verification experiment (measuring method) and criteria will be described.

A rectangular parallelopiped container of a predetermined volume in which a discharge opening (circular) is formed at the center portion of the bottom portion is prepared, and is filled with 200 g of developer; then, the filling port is sealed, and the discharge opening is plugged; in this state, the container is shaken enough to loosen the developer. The rectangular parallelopiped container has a volume of 1000 cm^3, 90 mm in length, 92 mm width and 120 mm in height.

Thereafter, as soon as possible the discharge opening is unsealed in the state that the discharge opening is directed downwardly, and the amount of the developer discharged through the discharge opening is measured. At this time, the rectangular parallelopiped container is sealed completely except for the discharge opening. In addition, the verification experiments were carried out under the conditions of the temperature of 24 degree C. and the relative humidity of 55%.

Using these processes, the discharge amounts are measured while changing the kind of the developer and the size of the discharge opening. In this example, when the amount of the discharged developer is not more than 2 g, the amount is negligible, and therefore, the size of the discharge opening at that time is deemed as being not enough to discharge the developer sufficiently only by the gravitation.

The developers used in the verification experiment are shown in Table 1. The kinds of the developer are one component magnetic toner, non-magnetic toner for two component developer developing device and a mixture of the non-magnetic toner and the magnetic carrier.

As for property values indicative of the property of the developer, the measurements are made as to angles of rest indicating flowabilities, and fluidity energy indicating easiness of loosing of the developer layer, which is measured by a powder flowability analyzing device (Powder Rheometer FT4 available from Freeman Technology).

TABLE 1

| Developers | Volume average particle size of toner (μm) | Developer component | Angle of rest (deg.) | Fluidity energy (Bulk density of 0.5 g/cm$^3$) |
|---|---|---|---|---|
| A | 7 | Two-component non-magnetic | 18 | $2.09 \times 10^{-3}$ J |
| B | 6.5 | Two-component non-magnetic toner + carrier | 22 | $6.80 \times 10^{-4}$ J |
| C | 7 | One-component magnetic toner | 35 | $4.30 \times 10^{-4}$ J |
| D | 5.5 | Two-component non-magnetic toner + carrier | 40 | $3.51 \times 10^{-3}$ J |
| E | 5 | Two-component non-magnetic toner + carrier | 27 | $4.14 \times 10^{-3}$ J |

Referring to FIG. 8, a measuring method for the fluidity energy will be described. Parts (a) and (b) of FIG. 8 are schematic views of a device for measuring fluidity energy. The principle of the powder flowability analyzing device is that a blade is moved in a powder sample, and the energy required for the blade to move in the powder, that is, the fluidity energy, is measured. The blade is of a propeller type, and when it rotates, it moves in the rotational axis direction simultaneously, and therefore, a free end of the blade moves helically.

The propeller type blade 54 is made of SUS (type=C210) and has a diameter of 48 mm, and is twisted smoothly in the counterclockwise direction. More specifically, from a center of the blade of 48 mm×10 mm, a rotation shaft extends in a normal line direction relative to a rotation plane of the blade, a twist angle of the blade at the opposite outermost edge portions (the positions of 24 mm from the rotation shaft) is 70°, and a twist angle at the positions of 12 mm from the rotation shaft is 35°.

The fluidity energy is total energy provided by integrating with time a total sum of a rotational torque and a vertical load when the helical rotating blade 54 enters the powder layer and advances in the powder layer. The value thus obtained indicates easiness of loosening of the developer powder layer, and large fluidity energy means less easiness and small fluidity energy means greater easiness.

In this measurement, as shown in FIG. 8, the developer T is filled up to a powder surface level of 70 mm (L2 in FIG. 8) into the cylindrical container 53 having a diameter ϕ of 50 mm (volume=200 cc, L1 (FIG. 8)=50 mm) which is the standard part of the device. The filling amount is adjusted in accordance with a bulk density of the developer to measure. The blade 54 of ϕ48 mm which is the standard part is advanced into the powder layer, and the energy required to advance from depth 10 mm to depth 30 mm is displayed.

The set conditions at the time of measurement are, The rotational speed of the blade 54 (tip speed=peripheral speed of the outermost edge portion of the blade) is 60 mm/s: The blade advancing speed in the vertical direction into the powder layer is such a speed that an angle θ (helix angle) formed between a track of the outermost edge portion of the blade 54 during advancement and the surface of the powder layer is 10°: The advancing speed into the powder layer in the perpendicular direction is 11 mm/s (blade advancement speed in the powder layer in the vertical direction=(rotational speed of blade)×tan (helix angle×π/180)): and The measurement is carried out under the condition of temperature of 24 degree C. and relative humidity of 55%.

The bulk density of the developer when the fluidity energy of the developer is measured is close to that when the experiments for verifying the relation between the discharge amount of the developer and the size of the discharge opening, is less changing and is stable, and more particularly is adjusted to be 0.5 g/cm^3.

The verification experiments were carried out for the developers (Table 1) with the measurements of the fluidity energy in such a manner. FIG. 9 is a graph showing a relation between a diameter of a discharge opening and a discharge amount, for various developers.

From the verification results shown in FIG. 9, it has been confirmed that the discharge amount through the discharge opening is not more than 2 g for each of the developers A-E, if the diameter ϕ of the discharge opening is not more than 4 mm (12.6 mm^2 in the opening area (circle ratio=3.14)). When the diameter ϕ discharge opening exceeds 4 mm, the discharge amount increases sharply. When the fluidity energy of the developer (0.5 g/cm^3 of the bulk density) is not less than 4.3×10^−4 kg-m^2/s^2 (J) and not more than 4.14×10^−3 kg-m^2/s^2 (J), it will suffice if the diameter of the discharge opening 4*a* is not more than 4 mm (12.6 (mm^2) of the opening area of the discharge opening 4*a*).

As for the bulk density of the developer, the developer has been loosened and fluidized sufficiently in the verification experiments, and therefore, the bulk density is lower than that expected in the normal use condition (left state), that is, the measurements are carried out in the condition in which the developer is more easily discharged than in the normal use condition.

The verification experiments were carries out as to the developer A with which the discharge amount is the largest in the results of FIG. 9, wherein the filling amount in the container were changed in the range of 30-300 g while the diameter ϕ of the discharge opening is constant at 4 mm. The verification results are shown in FIG. 10. From the results of FIG. 10, it has been confirmed that the discharge amount through the discharge opening hardly changes even if the filling amount of the developer changes. From the foregoing, it has been confirmed that by making the diameter ϕ of the discharge opening not more than 4 mm (12.6 mm^2 in the area), the developer is not discharged sufficiently only by the gravitation through the discharge opening in the state that the discharge opening is directed downwardly (supposed supplying attitude into the developer replenishing apparatus 201) irrespective of the kind of the developer or the bulk density state.

On the other hand, the lower limit value of the size of the discharge opening 4*a* is preferably such that the developer to be supplied from the supply container 1 (one component magnetic toner, one component non-magnetic toner, two component non-magnetic toner or two component magnetic carrier) can at least pass therethrough. More particularly, the discharge opening is preferably larger than a particle size of the developer (volume average particle size in the case of toner, number average particle size in the case of carrier) contained in the supply container 1. For example, in the case that the supply developer comprises two component non-magnetic toner and two component magnetic carrier, it is preferable that the discharge opening is larger than a larger particle size, that is, the number average particle size of the two component magnetic carrier.

Specifically, in the case that the supply developer comprises two component non-magnetic toner having a volume average particle size of 5.5 μm and a two component magnetic carrier having a number average particle size of 40 μm, the diameter of the discharge opening 4*a* is preferably not less than 0.05 mm (0.002 mm^2 in the opening area).

If, however, the size of the discharge opening 4*a* is too close to the particle size of the developer, the energy required for discharging a desired amount from the supply container 1, that is, the energy required for operating the pump portion 3*a* is large. It may be the case that a restriction is imparted to the manufacturing of the supply container 1. In order to mold the discharge opening 4*a* in a resin material part using an injection molding method, a metal mold part for forming the discharge opening 4*a* is used, and the durability of the metal mold part will be a problem. From the foregoing, the diameter ϕ of the discharge opening 4*a* is preferably not less than 0.5 mm.

In this example, the configuration of the discharge opening 4*a* is circular, but this is not inevitable. A square, a rectangular, an ellipse or a combination of lines and curves or the like are usable if the opening area is not more than 12.6 mm^2 which is the opening area corresponding to the diameter of 4 m.

However, a circular discharge opening has a minimum circumferential edge length among the configurations having the same opening area, the edge being contaminated by the deposition of the developer. However, a circular discharge opening has a minimum circumferential edge length among the configurations having the same opening area, the edge being contaminated by the deposition of the developer. In addition, with the circular discharge opening, a resistance during discharging is also small, and a discharging property is high. Therefore, the configuration of the discharge opening 4*a* is preferably circular which is excellent in the balance between the discharge amount and the contamination prevention.

From the foregoing, the size of the discharge opening 4*a* is preferably such that the developer is not discharged sufficiently only by the gravitation in the state that the discharge opening 4*a* is directed downwardly (supposed supplying attitude into the developer replenishing apparatus 201). More particularly, a diameter ϕ of the discharge opening 4*a* is not less than 0.05 mm (0.002 mm^2 in the opening area) and not more than 4 mm (12.6 mm^2 in the opening area). Furthermore, the diameter ϕ of the discharge opening 4*a* is preferably not less than 0.5 mm (0.2 mm^2 in the opening area and not more than $^4$ mm (12.6 mm^2 in the opening area). In this example, on the basis of the foregoing investigation, the discharge opening 4*a* is circular, and the diameter ϕ of the opening is 2 mm.

In this example, the number of discharge openings 4*a* is one, but this is not inevitable, and a plurality of discharge openings 4*a*, if the respective opening areas satisfy the above-described range. For example, in place of one developer receiving port 13 having a diameter ϕ of 3 mm, two discharge openings 4*a* each having a diameter ϕ of 0.7 mm are employed. However, in this case, the discharge amount of the developer per unit time tends to decrease, and therefore, one discharge opening 4*a* having a diameter ϕ of 2 mm is preferable.

(Cylindrical Portion)

Referring to FIGS. 6, 7, the cylindrical portion 2*k* functioning as the developer accommodating chamber will be described. The cylindrical portion 2*k* as the developer accommodating chamber is a chamber capable of accommodating the developer. As soon in FIGS. 6 and 7, an inner surface of the cylindrical portion 2*k* is provided with a feeding portion 2*c* which is projected and extended helically, the feeding projection 2*c* functioning as a feeding portion for feeding the developer accommodated in the developer accommodating portion 2 toward the discharging portion 4*c* (discharge opening 4*a*) functioning as the developer discharging chamber, with rotation of the cylindrical portion 2*k*. The cylindrical portion 2*k* is formed by a blow molding method from an above-described resin material.

In order to increase a filling capacity by increasing the volume of the supply container 1, it would be considered that the height of the discharging portion 4*c* as the developer accommodating portion 2 is increased to increase the volume thereof. However, with such a structure, the gravitation to the developer adjacent the discharge opening 4*a* increases due to the increased weight of the developer. As a result, the developer adjacent the discharge opening 3*a* tends to be compacted with the result of obstruction to the suction/discharging through the discharge opening 4*a*. In this case, in order to loosen the developer compacted by the suction through the discharge opening 4*a* or in order to discharge the developer by the discharging, the volume change of the pump portion 3*a* has to be increased. As a result, the driving force for driving the pump portion 3*a* has to be increased, and the load to the main assembly 100A of the image forming apparatus may be increased to an extreme extent.

In this example, the cylindrical portion 2*k* extends in the horizontal direction from the flange portion 4 so that the amount of the developer is adjusted by the volume of the cylindrical portion 2*k*, and therefore, the thickness of the developer layer on the discharge opening 4*a* in the supply container 1 can be made small as compared with the above-described high structure. By doing so, the developer does not tend to be compacted by the gravitation, and therefore, the developer can be discharged stably without large load to the main assembly 100A of the image forming apparatus.

As shown in part (b) and part (c) of FIG. 7, the cylindrical portion 2*k* is fixed rotatably relative to the flange portion 4 with a flange seal 5*b* of a ring-like sealing member provided on the inner surface of the flange portion 4 being compressed. By this, the cylindrical portion 2*k* rotates while sliding relative to the flange seal 5*b*, and therefore, the developer does not leak out during the rotation, and a hermetical property is provided. Thus, the air can be brought in and out through the discharge opening 4*a*, so that desired states of the volume change of the supply container 1 during the developer supply can be accomplished.

(Pump Portion)

Referring to FIG. 7, the description will be made as to the pump portion (reciprocable pump) 3*a* in which the volume thereof changes with reciprocation. Part (a) of FIG. 7 is a perspective view of a section of the supply container, Part (b) of FIG. 7 is a partially sectional view in a state in which the pump portion 3*a* is expanded to the maximum usable limit, and (c) is a partially sectional view in a state in which the pump portion 3*a* is contracted to the maximum usable limit.

The pump portion 3*a* of this example functions as a suction and discharging mechanism for repeating the sucking operation and the discharging operation alternately through the discharge opening 3*a*. In other words, the pump portion 3*a* functions as an air flow generating mechanism for generating repeatedly and alternately air flow into the supply container and air flow out of the supply container through the discharge opening 4*a*. The pump portion 3*a* is a part in which the inner volume of the cylindrical portion 2*k* can be changed in the longitudinal direction of the supply container 1 to apply a pressure at least to the discharge opening 4*a*.

As shown in part (b) of FIG. 7, the pump portion 3*a* is provided at a position away from the discharging portion 4*c* in a direction X. Thus, the pump portion 3*a* does not rotate in the rotational direction of the cylindrical portion 2*k* together with the discharging portion 4*c*.

The pump portion 3*a* of this example is capable of accommodating the developer therein. The developer accommodating space of the pump portion 3*a* plays an important function for the fluidization of the developer in the suction operation, as will be described hereinafter.

In this example, the pump portion 3*a* is a displacement type pump (bellow-like pump) of resin material in which the volume thereof changes with the reciprocation. More particularly, as shown in parts (a)-(c) of FIG. 7, the bellow-like pump includes crests and bottoms periodically and alternately. The pump portion 2*b* repeats the compression and the expansion alternately by the driving force received from the developer replenishing apparatus 201. In this example, the volume change by the expansion and contraction is 5 cm^3 (cc). The length L3 (part (b) of FIG. 7) is approx. 40 mm, the length L4 (part (c) of FIG. 7) is approx. 24 mm. The outer diameter R2 of the pump portion 3*a* is approx. 45 mm.

Using the pump portion 3*a* of such a structure, the volume of the supply container 1 can be alternately changed repeatedly at predetermined intervals. As a result, the developer in the discharging portion 4*c* can be discharged efficiently through the small diameter discharge opening 4*a* (diameter of approx. 2 mm).

(Drive Receiving Mechanism)

The description will be made as to a drive receiving mechanism (drive receiving portion, driving force receiving portion) of the supply container 1 for receiving the rotational force for rotating the cylindrical portion 2*k* provided with feeding projection 2*c* from the developer replenishing apparatus 201. As shown in part (a) of FIG. 6, the supply container 1 is provided with a gear portion 2*a* which functions as a drive receiving mechanism (drive receiving portion, driving force receiving portion) engageable (driving connection) with a driving gear 300 (functioning as driving mechanism) of the developer replenishing apparatus 201. The gear portion 2*d* as the driving force receiving portion receives a rotational force for rotating the inclination rib 6*a* from the driving gear 300 of the supplying device 201. The gear portion 2*d* and the cylindrical portion 2*k* are integrally rotatable.

Therefore, the rotational force inputted to the gear portion 2*d* from the driving gear 300 (FIG. 6) is transmitted to the pump portion 3*a* through a reciprocation member 3*b* shown in part (a) and (b) of FIG. 11, as will be described in detail hereinafter. The bellow-like pump portion 3*a* of this example is made of a resin material having a high property against torsion or twisting about the axis within a limit of not adversely affecting the expanding-and-contracting operation.

In this example, the gear portion 2*d* is provided at one longitudinal end (developer feeding direction) of the cylindrical portion 2*k*, but this is not inevitable, and the gear portion 2*a* may be provided at the other longitudinal end side of the developer accommodating portion 2, that is, the trailing end portion. In such a case, the driving gear 300 is provided at a corresponding position.

In this example, a gear mechanism is employed as the driving connection mechanism between the drive receiving portion of the supply container 1 and the driver of the developer replenishing apparatus 201, but this is not inevitable, and a known coupling mechanism, for example is usable. More particularly, in such a case, the structure may be such that a non-circular recess is provided as a drive receiving portion, and correspondingly, a projection having a configuration corresponding to the recess as a driver for the developer replenishing apparatus 201, so that they are in driving connection with each other.

(Drive Converting Mechanism)

A drive converting mechanism (drive converting portion) for the supply container 1 will be described. In this example, a cam mechanism is taken as an example of the drive converting mechanism. The supply container 1 is provided with the cam mechanism which functions as the driving force converting mechanism for converting the rotational force for rotating the cylindrical portion 2*k* received by the gear portion 2*d* to a force in the reciprocating directions of the pump portion 3*a*.

N this example, one drive receiving portion (gear portion 2*d*) receives the driving force for rotating the cylindrical portion 2*k* and for reciprocating the pump portion 3*a*, and the rotational force received by converting the rotational driving force received by the gear portion 2*d* to a reciprocation force in the supply container 1 side.

Because of this structure, the structure of the drive receiving mechanism for the supply container 1 is simplified as compared with the case of providing the supply container 1 with two separate drive receiving portions. In addition, the drive is received by a single driving gear of developer replenishing apparatus 201, and therefore, the driving mechanism of the developer replenishing apparatus 201 is also simplified.

Part (a) of FIG. 11 is a partial view in a state in which the pump portion is expanded to the maximum usable limit, (b) is a partial view in a state in which the pump portion is contracted to the maximum usable limit, and (c) is a partial view of the pump portion. As shown in part (a) of FIG. 11 and part (b) of FIG. 11, the used member for converting the rotational force to the reciprocation force for the pump portion 3*a* is the reciprocation member 3*b*. More specifically, it includes first and second rotatable cam grooves 2X and 2Y extended on the entire circumference of the portion integral with the driven receiving portion (gear portion 2*d*) for receiving the rotation from the driving gear 300. The cam grooves 2X and 2Y will be described hereinafter. The cam grooves 2X and 2Y are engageable with a reciprocation member engaging projection projected from the reciprocation member 3*b*.

The first and second cam grooves 2X and 2Y and the reciprocation member 3*b* as driving force converting portion converts the received rotational force into a feeding driving force to rotate the inclination rib 6*a* through the gear portion 2*d* to feed the developer by the operation of the pump portion 3*a* in the longitudinal direction of the supply container 1. In this example, as shown in part (c) of FIG. 11, the reciprocation member 3*b* is limited in the movement in the rotational moving direction of the cylindrical portion 2*k* by a protecting member rotation regulating portion 3*f* (play will be permitted) so that the reciprocation member 3*b* does not rotate in the rotational direction of the cylindrical portion 2*k*. By the movement in the rotational moving direction limited in this manner, it reciprocates along the grooves of the cam grooves 2X and 2Y (in the direction of the arrow X shown in FIG. 7 or the opposite direction).

A plurality of such reciprocation member engaging projections 3*c* are provided and are engaged with the cam grooves 2X and 2Y. More particularly, two engaging projections 3*c* are provided opposed to each other in the diametrical direction of the cylindrical portion 2*k* (approx. 180° opposing).

The number of the engaging projections 3*c* is satisfactory if it is not less than one. However, in consideration of the liability that a moment is produced by the drag force during the expansion and contraction of the pump portion 3*a* with the result of unsmooth reciprocation, the number is preferably plural as long as the proper relation is assured in relation to the configuration of the cam grooves 2X and 2Y which will be described hereinafter.

In this manner, by the rotation of the cam groove 2X or 2Y by the rotational force received from the driving gear 300, the reciprocation member engaging projection 3*c* reciprocates in the arrow X direction and the opposite direction along the cam groove 2X or 2Y. By this, the pump portion 3*a* repeats the expanded state (part (a) of FIG. 11) and the contracted state (part (b) of FIG. 11) alternately, thus changing the volume of the supply container 1.

(Set Conditions of Drive Converting Mechanism)

In this example, the driving force converting mechanism effects the drive conversion such that an amount (per unit time) of developer feeding to the discharging portion 4*c* by the rotation of the cylindrical portion 2*k* is larger than a discharging amount (per unit time) to the developer replenishing apparatus 201 from the discharging portion 4*c* by the function of the pump portion. This is because if the developer discharging power of the pump portion 2*b* is higher than the developer feeding power of the feeding projection 2*c* to the discharging portion 3*h*, the amount of the developer existing in the discharging portion 3*h* gradually decreases. In other words, it is avoided that the time period required for supplying the developer from the supply container 1 to the developer replenishing apparatus 201 is prolonged.

In addition, in the drive converting mechanism of this example, the drive conversion is such that the pump portion 3*a* reciprocates a plurality of times per one full rotation of the cylindrical portion 2*k*. This is for the following reasons.

In the case of the structure in which the cylindrical portion 2*k* is rotated inner the developer replenishing apparatus 201, it is preferable that the driving motor 500 is set at an output required to rotate the cylindrical portion 2*k* stably at all times. However, from the standpoint of reducing the energy consumption in the image forming apparatus 100 as much as possible, it is preferable to minimize the output of the driving motor 500. The output required by the driving motor 500 is calculated from the rotational torque and the rotational frequency of the cylindrical portion 2*k*, and therefore, in order to reduce the output of the driving motor 500, the rotational frequency of the cylindrical portion 2*k* is minimized.

However, in the case of this example, if the rotational frequency of the cylindrical portion 2*k* is reduced, a number of operations of the pump portion 3*a* per unit time decreases, and therefore, the amount of the developer (per unit time) discharged from the supply container 1 decreases. In other words, there is a possibility that the developer amount discharged from the supply container 1 is insufficient to quickly meet the developer supply amount required by the main assembly of the image forming apparatus 100.

If the amount of the volume change of the pump portion 3*a* is increased, the developer discharging amount per unit cyclic period of the pump portion 3*a* can be increased, and therefore, the requirement of the main assembly of the image forming apparatus 100 can be met, but doing so gives rise to the following problem. If the amount of the volume change of the pump portion 2*b* is increased, a peak value of the internal pressure (positive pressure) of the supply container 1 in the discharging stroke increases, and therefore, the load required for the reciprocation of the pump portion 2*b* increases.

For this reason, in this example, the pump portion 3*a* operates a plurality of cyclic periods per one full rotation of the cylindrical portion 2*k*. By this, the developer discharge amount per unit time can be increased as compared with the case in which the pump portion 3*a* operates one cyclic period per one full rotation of the cylindrical portion 2*k*, without increasing the volume change amount of the pump portion 3*a*. Corresponding to the increase of the discharge amount of the developer, the rotational frequency of the cylindrical portion 2*k* can be reduced. With the structure of this example, the required output of the driving motor 500 may be low, and therefore, the energy consumption of the main assembly of the image forming apparatus 100 can be reduced.

(Position of Driving Converting Mechanism)

As shown in FIG. 11, in this example, the driving force converting mechanism (cam mechanism constituted by the engaging projection 3*c* and cam grooves 2X and 2Y) is provided outside of developer accommodating portion 2. More particularly, the driving force converting mechanism is disposed at a position separated from the inside spaces of the cylindrical portion 2*k*, the pump portion 3*a* and the discharging portion 4*c*, so that the driving force converting mechanism does not contact the developer accommodated inside the cylindrical portion 2*k*, the pump portion 3 and the discharging portion 4.

By this, a problem which may arise when the driving force converting mechanism is provided in the inside space of the developer accommodating portion 2 can be avoided. More particularly, the problem is that by the developer entering portions of the driving force converting mechanism where sliding motions occur, the particles of the developer are subjected to heat and pressure to soften and therefore, they agglomerate into masses (coarse particle), or they enter into a converting mechanism with the result of torque increase. The problem can be avoided. Now, the description will be made as to the developer supplying step into the developer supplying apparatus 201 by the supply container 1.

(Developer Supplying Step)

Referring to FIGS. 11 and 12, a developer supplying step by the pump portion 3*a* will be described. Part (a) of FIG. 11 is a partial view in a state in which the pump portion is expanded to the maximum usable limit, (b) is a partial view in a state in which the pump portion is contracted to the maximum usable limit, and (c) is a partial view of the pump portion. FIG. 12 is an extended elevation illustrating the cam grooves 2X and 2Y, in the above-described driving force converting mechanism (cam mechanism including the engaging projection 3*c* and the cam grooves 2X and 2Y. The details of the cam grooves 2X and 2Y will be described hereinafter.

In this example, as will be described hereinafter, the drive conversion of the rotational force is carries out by the driving force converting mechanism so that the suction stroke by the pump operation (suction operation through discharge opening 4*a*), the discharging stroke (discharging operation through the discharge opening 4*a*) and the rest stroke by the non-operation of the pump portion (neither suction nor discharging is effected through the discharge opening 4*a*) are repeated alternately. The suction stroke, the discharging stroke and the rest stroke will be described.

(Suction Stroke)

First, the suction stroke (suction operation through discharge opening 4*a*) will be described. As shown in FIG. 11, the suction operation is effected by the pump portion 3*a* being changed from the most contracted state (part (b) of FIG. 11) to the most expanded state (part (a) of FIG. 11) by the above-described driving force converting mechanism (cam mechanism). More particularly, by the suction operation, a volume of a portion of the supply container 1 (pump portion 3*a*, cylindrical portion 2*k* and discharging portion 4*c*) which can accommodate the developer increases.

At this time, the supply container 1 is substantially hermetically sealed except for the discharge opening 4*a*, and the discharge opening 3*a* is plugged substantially by the developer T. Therefore, the internal pressure of the supply container 1 decreases with the increase of the volume of the portion of the supply container 1 capable of containing the developer T. At this time, the internal pressure of the supply container 1 is lower than the ambient pressure (external air pressure). For this reason, the air outside the supply container 1 enters the supply container 1 through the discharge opening 4*a* by a pressure difference between the inside and the outside of the supply container 1.

At this time, the air is taken-in from the outside of the supply container 1, and therefore, the developer T in the neighborhood of the discharge opening 4*a* can be loosened (fluidized). More particularly, the air impregnated into the developer powder existing in the neighborhood of the discharge opening 4*a*, thus reducing the bulk density of the developer powder T and fluidizing. Since the air is taken into the supply container 1 through the discharge opening 4*a*, the internal pressure of the supply container 1 changes in the neighborhood of the ambient pressure (external air pressure) despite the increase of the volume of the supply container 1.

In this manner, by the fluidization of the developer T, the developer T does not pack or clog in the discharge opening 4*a*, so that the developer can be smoothly discharged through the discharge opening 4*a* in the discharging operation which will be described hereinafter. Therefore, the amount of the developer T (per unit time) discharged through the discharge opening 4*a* can be maintained substantially at a constant level for a long term.

For effecting the sucking operation, it is not inevitable that the pump portion 3*a* changes from the most contracted state to the most expanded state, but the sucking operation is effected if the internal pressure of the supply container 1 changes even if the pump portion changes from the most contracted state halfway to the most expanded state. That is, the suction stroke corresponds to the state in which the reciprocation member engaging projection 3*c* is engaged with the cam groove (second operation portion) 2*h* shown in FIG. 12.

(Discharging Stroke)

The discharging stroke (discharging operation through the discharge opening 4*a*) will be described. As shown in part (b) of FIG. 12, the discharging operation is effected by the pump portion 3*a* being changed from the most expanded state to the most contracted state. More particularly, by the discharging operation, a volume of a portion of the supply container 1 (pump portion 3*a*, cylindrical portion 2*k* and discharging portion 4*c*) which can accommodate the developer decreases. At this time, the supply container 1 is substantially hermetically sealed except for the discharge opening 4*a*, and the discharge opening 4*a* is plugged substantially by the developer T until the developer is discharged. Therefore, the internal pressure of the supply container 1 rises with the decrease of the volume of the portion of the supply container 1 capable of containing the developer T.

The internal pressure of the supply container 1 is higher than the ambient pressure (the external air pressure), and therefore, the developer T is pushed out by the pressure difference between the inside and the outside of the supply container 1. That is, the developer T is discharged from the supply container 1 into the developer replenishing apparatus 201. Also air in the supply container 1 is also discharged with the developer T, and therefore, the internal pressure of the supply container 1 decreases. As described in the foregoing, according to this example, the discharging of the developer can be effected efficiently using one reciprocation type pump portion 3*a*, and therefore, the mechanism for the developer discharging can be simplified.

For effecting the discharging operation, it is not inevitable that the pump portion 3*a* changes from the most expanded state to the most contracted state, but the discharging operation is effected if the internal pressure of the supply container 1 changes even if the pump portion changes from the most expanded state halfway to the most contracted state. That is, the discharging stroke corresponds to the state in which the reciprocation member engaging projection 3*c* is engaged with the cam groove 2 *g* shown in FIG. 12.

(Rest Stroke)

The rest stroke in which the pump portion 3*a* does not to reciprocate will be described. In this example, as described hereinbefore, the operation of the driving motor 500 is controlled by the control device 600 on the basis of the results of the detection of the magnetometric sensor 800*c* and/or the developer sensor 10*d*. With such a structure, the amount of the developer discharged from the supply container 1 directly influences the toner content of the developer, and therefore, it is necessary to supply the amount of the developer required by the image forming apparatus from the supply container 1. At this time, in order to stabilize the amount of the developer discharged from the supply container 1, it is desirable that the amount of volume change at one time is constant.

If, for example, the cam grooves 2X and 2Y include only the portions for the discharging stroke and the suction stroke, the motor actuation may stop at halfway of the discharging stroke or suction stroke. After the stop of the driving motor 500, the cylindrical portion 2*k* continues rotating by the inertia, by which the pump portion 3*a* continues reciprocating until the cylindrical portion 2*k* stops, during which the discharging stroke or the suction stroke continues. The distance through which the cylindrical portion 2*k* rotates by the inertia is dependent on the rotational speed of the cylindrical portion 2*k*. Further, the rotational speed of the cylindrical portion 2*k* is dependent on the torque applied to the driving motor 500. From this, the torque to the motor changes depending on the amount of the developer in the supply container 1, and the speed of the cylindrical portion 2*k* may also change, and therefore, it is difficult to stop the pump portion 3*a* at the same position.

In order to stop the pump portion 3*a* at the same position, a region in which the pump portion 3*a* does not reciprocate even during the rotation of the cylindrical portion 2*k* is required to be provided in the cam grooves 2X and 2Y. In this embodiment, for the purpose of preventing the reciprocation of the pump portion 3*a*, there is provided a cam groove 2*i* (FIG. 12). The cam groove 2*i* extends in the rotational moving direction of the cylindrical portion 2*k*, and therefore, the reciprocation member 3*b* does not move despite the rotation (straight shape). That is, the rest stroke corresponds to the reciprocation member engaging projection 3*c* engaging with the cam groove 2*i*.

The non-reciprocation of the pump portion 3*a* means that the developer is not discharged through the discharge opening 4*a* (except for the developer falling through the discharge opening 4*a* due to the vibration or the like during the rotation of the cylindrical portion 2*k*). Thus, if the discharging stroke or suction stroke through the discharge opening 4*a* is not effected, the cam groove 2*i* may be inclined relative to the rotational moving direction toward the rotation axial direction. When the cam groove 2*i* is inclined, the reciprocation of the pump portion 3*a* corresponding to the inclination is permitted.

(Change of Internal Pressure of Supply Container)

Verification experiments were carried out as to a change of the internal pressure of the supply container 1. The verification experiments will be described. The developer is filled such that the developer accommodating space in the supply container 1 is filled with the developer; and the change of the internal pressure of the supply container 1 is measured when the pump portion 3*a* is expanded and contracted in a range of 5 cm^3 of volume change. The internal pressure of the supply container 1 is measured using a pressure gauge (AP-C40 available from Kabushiki Kaisha KEYENCE) connected with the supply container 1.

FIG. 13 shows a pressure change when the pump portion 3*a* is expanded and contracted in the state that the shutter 4*b* of the supply container 1 filled with the developer is open, and therefore, in the communicatable state with the outside air. In FIG. 13, the abscissa represents the time, and the ordinate represents a relative pressure in the supply container 1 relative to the ambient pressure (reference (1 kPa) (+ is a positive pressure side, and – is a negative pressure side).

When the internal pressure of the supply container 1 becomes negative relative to the outside ambient pressure by the increase of the volume of the supply container 1, the air is taken in through the discharge opening 4*a* by the pressure difference. When the internal pressure of the supply container 1 becomes positive relative to the outside ambient pressure by the decrease of the volume of the supply container 1, a pressure is imparted to the inside developer. At this time, the inside pressure eases corresponding to the discharged developer and air.

By the verification experiments, it has been confirmed that by the increase of the volume of the supply container 1, the internal pressure of the supply container 1 becomes negative relative to the outside ambient pressure, and the air is taken in by the pressure difference. In addition, it has been confirmed that by the decrease of the volume of the supply container 1, the internal pressure of the supply container 1 becomes positive relative to the outside ambient pressure, and the pressure is imparted to the inside developer so that the developer is discharged. In the verification experiments, an absolute value of the negative pressure is approx. 1.2 kPa, and an absolute value of the positive pressure is approx. 0.5 kPa.

As described in the foregoing, with the structure of the supply container 1 of this example, the internal pressure of the supply container 1 switches between the negative pressure and the positive pressure alternately by the suction operation and the discharging operation of the pump portion 3*a*, and the discharging of the developer is carried out properly.

As described in the foregoing, the example, a simple and easy pump portion capable of effecting the suction operation and the discharging operation of the supply container 1 is provided, by which the discharging of the developer by the air can be carries out stably while providing the developer loosening effect by the air.

In other words, with the structure of the example, even when the size of the discharge opening 4*a* is extremely small, a high discharging performance can be assured without imparting great stress to the developer since the developer can be passed through the discharge opening 4*a* in the state that the bulk density is small because of the fluidization.

In addition, in this example, the inside of the displacement type pump portion 3*a* is utilized as a developer accommodating space, and therefore, when the internal pressure is reduced by increasing the volume of the pump portion 3*a*, an additional developer accommodating space can be formed. Therefore, even when the inside of the pump portion 3*a* is filled with the developer, the bulk density can be decreased (the developer can be fluidized) by impregnating the air in the developer powder. Therefore, the developer can be filled in the supply container 1 with a higher density than in the conventional art.

(Regulating Portion)

Referring to FIG. 7, the regulating portion 7 will be described in detail. Part (a) of FIG. 7 is a perspective view of a section of the supply container 1, part (b) of FIG. 7 is a partially sectional view when the pump is expanded to the maximum extent, and part (c) of FIG. 7 is a partially sectional view in the state that the pump portion is contracted to the usable maximum extent.

As shown in part (a) of FIG. 7, the regulating portion 7 in this structure is provided integrally at a pump portion (3*a*) side end portion of the feeding member 6. Therefore, the regulating portion 7 also rotates in interrelation with the rotating operation of the feeding member 6 which rotates integrally with the cylindrical portion 2*k*.

The regulating portion 7 has such a configuration as to cover the storage portion 4*d* provided in the flange portion 4 depending on the rotational phase, and it periodically repeats covering and uncovering the upper portion of the storage portion 4*d* in interrelation with the rotation. The operation will be described in detail. The developer fed from the cylindrical portion 2*k* is stored in the storage portion 4*d* and in the neighborhood of the upper part thereof, and thereafter, the developer in the upper portion of the storage portion 4*d* is pushes aside by the regulating portion 7. When the discharging stroke is carried out in this state, only the developer in the storage portion 4*d* discharged. At this time, as long as the regulating portion 7 covers the upper portion of the storage portion 4*d*, the flow of the developer into the storage portion 4*d* from the portion therearound is limited, and therefore, the developer other than that within the storage portion 4*d* is not discharged.

Therefore, by covering the upper portion of the storage portion 4*d* by the regulating portion 7, the flow of the developer into the storage portion 4*d* is prevented, and the developer powder surface in the storage portion 4*d* is maintained constant. In the discharging stroke, when the developer in the storage portion 4*d* is discharged, the spaces inside and outside of the supply container 1 are communicated with each other, and then only the air is discharged, so that the continuous discharging of the developer due to the pressure difference between the inside and the outside of the supply container 1 can be prevented.

As will be understood from the foregoing, with this structure of this example having the regulating portion 7, a constant amount of the developer stored in the storage portion 4*d* can be discharged at all times in the discharging stroke, and therefore, the developer can be discharged with stabilized supply accuracy.

After the developer is discharged, no developer exists inside the storage portion 4*d* apart from the developer deposited on the walls. From this state, the developer is fed into the storage portion 4*d* again by the further rotation of the feeding member 6, and the same steps are repeated. Accordingly, the developer can be discharged with the stabilized supply accuracy from the initial stage to a later stage of the discharging operation.

(Cam Grooves)

Referring to FIGS. 12, 14 and 15, cam grooves 2X and 2Y will be described. FIG. 12 is a development of a driving force converting mechanism portion corresponding to one full rotation of the cylindrical portion 2*k*. Parts (a) and (b) of FIG. 14, and FIG. 15 are developments of the driving force converting mechanism portion of modified examples.

In FIG. 12, an arrow A indicates a rotational moving direction of a cylindrical portion 2*k* (moving directions of the cam grooves 2X and 2Y), an arrow B indicates an expanding direction of the pump portion 3*a*, and an arrow C indicates a compressing direction of the pump portion 3*a*. The cam grooves 2X, 2Y include cam grooves 2*g*, 2*m* functioning when the pump portion 3*a* is compressed, cam grooves 2*h*, 2*n* functioning when the pump portion 3*a* is expanded, and cam grooves 2*i* with which the pump portion 3*a* does not function (pump portion non-operation portion). Designated by K2 and K1 are amplitudes (expansion and contraction length of the pump portion 3*a*) of the cam grooves in the expansion and contracting directions B, C of the pump portion 3*a*. In this example, K1>K2 is satisfied.

As shown in FIG. 12, the cam grooves 2X, 2Y as a drive converting portion include the first cam groove 2X (including cam grooves 2*n*, 2*m*) extending in the longitudinal direction of the supply container 1 while snaking in the rotational moving direction of the supply container 1. The cam grooves 2X, 2Y include a second cam groove 2Y (including cam grooves 2*g*, 2*h*) extending in the longitudinal direction of the supply container 1 while snaking in the rotational moving direction of the supply container 1 to a less extent than in the first cam groove 2X.

The reciprocation member 3*b* reciprocates in the longitudinal direction of the supply container 1 by a part thereof moving in engagement with the first cam groove 2X or the second cam groove 2Y. After the part of the reciprocation member 3*b* moves in engagement with the first cam groove 2X, it moves in engagement with the second cam groove 2Y only.

The first cam groove 2X and the second cam groove 2Y are connected with each other at the position of a stepped portion 2*p*. Here, the stepped portion 2*p* is provided at the connecting position between the first cam groove 2X and the second cam groove 2Y, and the surface of the second cam groove 2Y is lower than the surface of the first cam groove 2X toward the rotation axis of the cylindrical portion 2*k*.

The operation of the engaging projection 3*c* and the cam grooves 2X, 2Y will be described. When the supply container 1 is used for the first time, the engaging projection 3*c* is at a position downstream of the first cam groove 2X with respect to the rotational direction of the cylindrical portion 2*k*, as shown in FIG. 12. In this example, the engaging projection 3*c* is provided at each of two diametrically opposite positions, and therefore, they are engaged with the first cam grooves 2X, respectively.

When the cam grooves 2X, 2Y start to rotate with this state, the engaging projection 3*c* move along the first cam groove 2X. The engaging projection 3*c* moves along the cam groove 2*n*, the cam groove 2*i*, the cam groove 2*m*, and the stepped portion 2*p* then to the second cam groove 2Y. The function of the stepped portion 2*p* will be described in detail hereinafter. The operation of the pump portion 3*a* at this time is an above-described suction stroke because the engaging projection 3*c* moves along the cam groove 2*n* in the direction of expanding the pump portion 3*a* (B direction). In addition, when the engaging projection 3*c* moves along the cam groove 2*m*, the pump portion 3*a* move in the compressed in the direction indicated by the arrow C, that is, the discharging stroke is carried out. The amplitude of the reciprocation of the pump portion 3*a* at this time is K1 as depicted in FIG. 12.

Then, the engaging projection 3*c* having moved to the second cam groove 2Y moves thereafter along the cam groove 2*i*, the cam groove 2*h*, the cam groove 2 *g* in the order named, and subsequently, the engaging projection 3*c* moves always along the second cam groove 2Y. When the engaging projection 3*c* moves along the cam groove 2*h*, the pump portion 3*a* moves in the expanding direction, that is, the suction stroke is carried out. When the engaging projection 3*c* moves along the cam groove 2*g*, the pump portion 3*a* moves in the compressed in the direction, that is, the discharging stroke is carried out. The amplitude of the reciprocation of the pump portion 3*a* at this time is K2 as depicted in FIG. 12.

The stepped portion 2*p* will be described. The stepped portion 2*p* is a step provided at a connecting portion between the first cam groove 2X and the second cam groove 2Y, and the second cam groove 2Y is lower than the first cam groove 2X (the diameter of the second cam groove Y as measured from the center of the container). The reciprocation member 3*b* is supported by the flange portion 4 as described hereinbefore, and the engaging projection 3*c* is urged toward the cam grooves 2X and 2Y.

The operation will be described in detail. The engaging projection 3*c* moving from the first cam groove 2X to the second cam groove 2Y passes the stepped portion 2*p* and enters the second cam groove 2Y which is at a lower level than the bottom surface of the first cam groove 2X. Then, the engaging projection 3*c* moves in the first cam groove 2X to the stepped portion 2*p*. At this time, the engaging projection 3*c* is urged toward the second cam groove Y, and therefore, the engaging projection 3*c* does not ride on the step back into the first cam groove 2X. With such a structure, after the engaging projection 3*c* enter the second cam groove 2Y from the first cam groove 2X, the engaging projection 3*c* does not return into the first cam groove 2X.

Without the stepped portion 2*p*, there is a possibility that the engaging projection 3*c* enters back again into the first cam groove 2X at the connecting portion between the first cam groove 2X and the second cam groove 2Y. If this occurs, the pump portion 3*a* makes an expanding-and-contracting operation adjacent the stepped portion 2*p* with the result of an intentional developer discharge. The provision of the stepped portion 2*p* at the connecting portion between the first cam groove 2X and the second cam groove 2Y is effective to prevent the occurrence of such unintentional discharged.

The stepped portion 2*p* is an example of the structures effect in the prevention, and a flap 2*q* may replace the stepped portion 2*p*. The flap 2*q* is capable of rotating about a rotational axis 2*q*1. When the engaging projection 3*c* moves from the first cam groove 2X into the second cam groove 2Y, the engaging projection 3*c* pushes the flap 2*q* away, as shown in part (a) of FIG. 14.

After the engaging projection 3*c* moves into the second cam groove 2Y, the engaging projection 3*c* rotates the flap 2*q* in the direction indicated by an arrow B as shown in part (b) of FIG. 14, and therefore, upon passing the connecting portion, the flap 2*q* is in the closing position to close the passage into the first cam groove 2X. That is, the once the engaging projection 3*c* moves into the second cam groove 2Y, the engaging projection 3*c* always moves in the second cam groove 2Y. The effects of the flap 2*q* are similar to those of the stepped portion 2*p*, and the unintentional expanding-and-contracting operation of the pump portion 3*a* at the connecting portion between the first cam groove 2X and the second cam groove 2Y is prevented, thus preventing unintentional developer discharging.

As described above, after the engaging projection 3*c* move along the first cam groove 2X, the engaging projection 3*c* enters the second cam groove 2Y and thereafter moves along the second cam groove 2Y at all times. When the engaging projection 3*c* move along the first cam groove 2X, the amplitude of the pump portion 3*a* is K1, and thereafter, the amplitude is K2 (along the second cam groove 2Y). As described in the foregoing, K1>K2 is satisfied.

The expansion and contraction stroke of the reciprocation member 3*b* in the initial rotation period (the amplitude of the first pumping strokes) provided by the inclination rib 6*a* receiving the rotational force through the gear portion 2*d* is different from the expansion and contraction stroke in the subsequent rotation period (the amplitude of the second and subsequent pumping strokes). In the initial rotation period, the cylindrical portion 2*k* having the inclination rib 6*a* rotates at predetermined turns in the initial stage.

Particularly, the first cam groove 2X, the second cam groove 2Y and the reciprocation member 3*b* are constituted such that the expansion and contraction stroke in the initial rotation period of the pump portion 3*a* is larger than that in the subsequent rotation periods. More specifically, the amplitude in the initial one pumping operation is relatively larger, and the amplitude of the second and subsequent operations is relatively smaller.

The reasons for such an arrangement will be described. After the manufacturing of the supply container 1, it is subjected to various kinds of vibration during the transportation to a user. During the transportation, the bulk density of the developer powder in the supply container 1 may be caked (not easily loosened). Particularly if the developer in the storage portion 4*d* (FIG. 7) is caked, the developer may not be loosened by the suction stroke and the discharging stroke of the pump portion 3*a* with the possibility of non-discharge of the developer from the supply container 1.

By making the amplitude of the pump portion 3*a* large so that the pressure imparted to the developer is made high for assured functions of the suction stroke and the discharging stroke. Particularly in the suction stroke, the suction of the air is effective to loosen the developer in the storage portion 4*d*, and therefore, the loosening effect by increasing the amplitude in the suction stroke is strong. The amplitude of the pump portion 3*a* to assure the discharging of the developer may be properly determined by one skilled in the art depending on the kind of the developer and the transportation level.

In this manner, the larger amplitude of the pump portion 3*a* is effective to assure the discharged of the developer in the initial stage, and once the developer is loosened, the pressure required to discharged the developer is not very high. For this reason, if the pressure is selected to meet the pressure required in the initial stage, the pressure is higher than the required pressure for the developer discharged in the subsequent operation. As a result, the developer is discharged normally with the pressure of higher than necessary, and therefore, the load to the driving system of the image forming apparatus is too large with the waste of energy.

In this embodiment, the amplitude is changed only in the first one bump in the stroke, but the amplitude is made larger in a plurality of pumping strokes in the initial stage by increasing the number of cam grooves 2*n* and cam grooves 2*m* of the first cam groove 2X, as shown in FIG. 15. With such a structure, the high pressure can be imparted to the developer in the polarity of initial strokes, by which the developer loosening effect is further stronger.

In this example, the two engaging projections 3*c* are employed, and therefore, the first cam groove 2X is provided for one half rotation, but only one engaging projection 3*c* may be provided, and first cam groove 2X is provided for one full rotation. With such a structure, the first cam groove 2X is provided for one or a plurality of rotations using a helical structure, a plurality of suction and discharge strokes of the pump portion 3*a* can be carried out. Then, the pump portion 3*a* can be operated a plurality of times with the amplitude which is different from that provided by the second cam groove 2Y. The specific structures to be employed can be properly determined by one skilled in the art in view of the property of the developer and the level of the transportation.

As described in the foregoing, using the above-described structures, the amplitude of the operation of the pump portion 3*a* is made larger only in the initial stage or stages, and thereafter, the amplitude can be made smaller after the developer begins to discharge, by which the initial discharging property and the reduction of the drive load in the subsequent stage can be assured. Accordingly, with the above-described the structures, the developer can be stably discharged with less drive energy from the initial stage to the subsequent stage.

Embodiment 2

Referring to FIG. 16, Embodiment 2 will be described. FIG. 16 is a development of cam grooves 2X, 2Y in Embodiment 2. As will be understood from FIG. 16, the cam grooves 2X, 2Y a different from those of Embodiment 1. The other structures are the same as those of Embodiment 1. In the description of this embodiment, the same reference numerals as in Embodiment 1 are assigned to the elements having the corresponding functions in this embodiment, and the detailed description thereof is omitted for simplicity.

As shown in FIG. 16, the difference of this embodiment from Embodiment 1 is in that an amplitude K1 (expansion and contraction length of the pump portion 3*a*) in the expansion and contracting directions B, C of the pump portion 3*a* provided by the first cam groove 2X is small.

More particularly, in this embodiment, the driving force converting portion includes a first cam groove 2X which is formed on and which extends in the rotational moving direction of the supply container 1 while snaking in the longitudinal direction of the supply container 1. The driving force converting portion includes a second cam groove 2Y which is formed on and which extends in the rotational moving direction of the supply container 1 while snaking in the longitudinal direction of the supply container 1. A part of the reciprocation member 3*b* moves along the first cam groove 2X with second cam groove 2Y, by which the reciprocation member 3*b* reciprocates in the longitudinal direction of the supply container 1. After the part of the reciprocation member 3*b* moves in engagement with the first cam groove 2X, the part moves in engagement with the second cam groove 2Y only. The driving force converting portion effects the conversion such that the expansion and contraction stroke in the initial rotation period of the pump portion 3*a* is smaller than the expansion and contraction stroke after the initial rotation period.

As shown in FIG. 16, the first cam groove 2X is provided adjacent to the second cam groove 2Y, and similarly to Embodiment 1, the are connected with each other at the stepped portion 2*p*. In the operation, when the supply container 1 is used first, the engaging projection 3*c* is downstream of the first cam groove 2X with respect to the rotational moving direction of the cylindrical portion 2*k*, as shown in FIG. 16. In addition, the engaging projection 3*c* is provided at each of two diametrically opposed the positions, and therefore, the engaging projections 3*c* are engaged with the respective first cam grooves 2X.

Thereafter, with the rotation of the cam grooves 2X, 2Y, the engaging projection 3*c* moves along the first cam groove 2X. The engaging projection 3*c* moves along the cam groove 2*n*, the cam groove 2*i*, the cam groove 2*m*, and the stepped portion 2*p* in the order named and then to the second cam groove 2Y. The function of the stepped portion 2*p* and the operation of the pump portion 3*a* are similar to those of Embodiment 1. The amplitude of the reciprocation of the pump portion 3*a* at this time is K1 as depicted in FIG. 12. Thereafter, the operation of the engaging projection 3*c* having entered second cam groove 2Y is similar to that of Embodiment 1. The amplitude of the reciprocation of the pump portion 3*a* at this time is K1 as depicted in FIG. 16.

As described above, after the engaging projection 3*c* move along the first cam groove 2X, the engaging projection 3*c* enters the second cam groove 2Y and thereafter moves along the second cam groove 2Y at all times. When the engaging projection 3*c* move along the first cam groove 2X, the amplitude of the pump portion 3*a* is K1, and thereafter, the amplitude is K2 (along the second cam groove 2Y). Since K2>K1, the amplitude of the first pump operation is relatively small, and the amplitude thereafter is relatively large.

In Embodiment 1, the amplitude of the pump portion 3*a* in the initial discharging the stage is relatively larger, and it is made relatively smaller subsequently, but in this embodiment, the situation is the opposite, that is, the amplitude in the initial stage is relatively small, and it is relatively larger in the subsequent stage.

The reason for this arrangement will be described. Here, it is assumed that the caking of the developer during the transportation so less that the developer can be discharged with the amplitude K2 (FIG. 16) of the pump portion 3*a*. It has been confirmed that when the bulk density of the developer in the supply container 1 increases as a result of vibration during transportation, the rotation resisting force at the time when the cylindrical portion 2*k* rotates relative to the flange portion 4 is higher than when the developer is loosened. The drive load to the main assembly of the image forming apparatus is determined as a total sum of the expansion and contraction force of the pump portion 3*a* and the rotation resisting forces for the relative rotation between the cylindrical portion 2*k* and the flange portion 4, and the expansion and contraction force and the rotation resisting force are both large in the caked state of the developer after the transportation, and therefore, the large load is applied to the driving system.

In view of this, the amplitude of the pump portion 3*a* in a plurality of initial strokes is made relatively smaller, by which the expansion and contraction force decreases, the suppressing the increase of the drive load. After the engaging projection 3*c* enters the second cam groove 2Y thereafter, the pump portion 3*a* is operated with an amplitude K2 optimum for the discharge of the developer. If the pump portion 3*a* is operated with the amplitude K1 from the initial stage to the subsequent stage, the drive load is relatively smaller, but the amplitude is not enough stably discharge the developer, and therefore, the developer is not discharged stably.

The initial amplitude of the pump portion 3*a* may be provided determined by one skilled in the art depending on the balance of the time duration to the start of the discharged and the drive load. The time duration to the start of the discharging and the drive load are in a trade-off relationship, and when the amplitude is 0, the drive load is the minimum, and with the increase of the amplitude, the drive load increases.

As described in the foregoing, according to the embodiment of the present invention, the amplitude of the pump portion 3*a* is made relatively smaller in the initial stage, and in the subsequent the stage after the start of the discharge of the developer, the amplitude is made relatively large, by which the reduction of the initial drive load and the discharging stability can both be accomplished. Therefore, the developer can be stably discharged by a small drive load from the initial stage you to the subsequent stage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-228138 filed on Nov. 10, 2014, which is hereby incorporated by reference herein in its entirety.

What is claimed is:

1. A developer supply container detachably mountable to a developer supplying device, said developer supply container comprising:

a developer accommodating chamber capable of accommodating developer;

a rotatable feeding portion configured to feed the developer in said developer accommodating chamber;

a developer discharging chamber including a discharge opening for permitting discharge of the developer fed by said feeding portion;

a driving force receiving portion configured to receive a rotational force for rotating said feeding portion;

a pump portion capable of changing an inside volume of said developer accommodating chamber in a longitudinal direction of said developer supply container to apply a pressure at least to said discharge opening; and a driving force converting portion configured to convert the rotational force received by said driving force receiving portion into a feeding driving force for feeding the developer by an operation of said pump portion in the longitudinal direction of said developer supply container, wherein an expansion and contraction stroke of said pump portion provided by said driving force converting portion in an initial predetermined number of rotations in an initial stage is different from that in a subsequent stage after the initial stage.

2. A developer supply container according to claim 1, wherein the expansion and contraction stroke in the initial stage is larger than that in the subsequent stage.

3. A developer supply container according to claim 2, wherein said driving force converting portion includes:

a first cam groove formed on said developer supply container and extending in a rotational moving direction of said developer supply container while snaking in the longitudinal direction of said developer supply container;

a second cam groove formed on said developer supply container and extending in the rotational moving direction of said developer supply container while snaking in the longitudinal direction of said developer supply container to a less degree than said first cam groove; and a reciprocation member configured to reciprocate in the longitudinal direction of said developer supply container by movement of a part thereof engaged with said first cam groove or said second cam groove, wherein said reciprocation member moves by the part of said reciprocation member being in engagement with said first cam groove and then moves by the part of said reciprocation member being in engagement with said second cam groove only.

4. A developer supply container according to claim 3, wherein said first cam groove and said second cam groove periodically snake in the rotational moving direction of said developer supply container.

5. A developer supply container according to claim 1, wherein the expansion and contraction stroke in the initial stage is smaller than that in the subsequent stage.

6. A developer supply container according to claim 5, wherein said driving force converting portion includes:

a first cam groove formed on said developer supply container and extending in a rotational moving direction of said developer supply container while snaking in the longitudinal direction of said developer supply container;

a second cam groove formed on said developer supply container and extending in the rotational moving direction of said developer supply container while snaking in the longitudinal direction of said developer supply container to a larger degree than in said first cam groove; and a reciprocation member configured to reciprocate in the longitudinal direction of said developer supply container by movement of a part thereof engaged with said first cam groove or said second cam groove, wherein said reciprocation member moves by the part of said reciprocation member being in engagement with said first cam groove and then moves by the part of said reciprocation member being in engagement with said second cam groove only.

7. A developer supplying device comprising:

a mounting portion for mounting a developer supply container; and a developer supply container including:

a developer accommodating chamber capable of accommodating developer, a rotatable feeding portion configured to feed the developer in said developer accommodating chamber, a developer discharging chamber including a discharge opening for permitting discharge of the developer fed by said feeding portion, a driving force receiving portion configured to receive a rotational force for rotating said feeding portion, a pump portion capable of changing an inside volume of said developer accommodating chamber in a longitudinal direction of said developer supply container to apply a pressure at least to said discharge opening, and a driving force converting portion configured to convert the rotational force received by said driving force receiving portion into a feeding driving force for feeding the developer by an operation of said pump portion in the longitudinal direction of said developer supply container, wherein an expansion and contraction stroke of said pump portion provided by said driving force converting portion in an initial predetermined number of rotations in an initial stage is different from that in a subsequent stage after the initial stage.

8. An image forming apparatus for forming an image on a recording material, said apparatus comprising:

a developer supplying device including:

a mounting portion for mounting a developer supply container; and a developer supply container including:

a developer accommodating chamber capable of accommodating a developer, a rotatable feeding portion configured to feed the developer in said developer accommodating chamber, a developer discharging chamber including a discharge opening for permitting discharge of the developer fed by said feeding portion, a driving force receiving portion configured to receive a rotational force for rotating said feeding portion, a pump portion capable of changing an inside volume of said developer accommodating chamber in a longitudinal direction of said developer supply container to apply a pressure at least to said discharge opening, and a driving force converting portion configured to convert the rotational force received by said driving force receiving portion into a feeding driving force for feeding the developer by an operation of said pump portion in the longitudinal direction of said developer supply container, wherein an expansion and contraction stroke of said pump portion provided by said driving force converting portion in the initial predetermined number of rotations in the initial stage is different from that in a subsequent stage after the initial stage.

* * * * *